US011661810B2

(12) United States Patent
McLeod et al.

(10) Patent No.: US 11,661,810 B2
(45) Date of Patent: May 30, 2023

(54) METHOD AND SYSTEM FOR ENABLING ACQUISITION OF BOREHOLE SURVEY DATA AND CORE ORIENTATION DATA

(71) Applicant: IMDEX GLOBAL B.V., Amsterdam-Zuidoost (NL)

(72) Inventors: Gavin McLeod, Attadale (AU); Kelvin Brown, Sorrento (AU); Gertej Singh Jabbal, Tapping (AU)

(73) Assignee: Reflex Instruments Asia Pacific Pty Ltd, Balcatta (AU)

( * ) Notice: Subject to any disclaimer, the term of this patent is extended or adjusted under 35 U.S.C. 154(b) by 1040 days.

(21) Appl. No.: 16/072,449

(22) PCT Filed: Jan. 23, 2017

(86) PCT No.: PCT/AU2017/050049
§ 371 (c)(1),
(2) Date: Jul. 24, 2018

(87) PCT Pub. No.: WO2017/127885
PCT Pub. Date: Aug. 3, 2017

(65) Prior Publication Data

US 2019/0024468 A1 Jan. 24, 2019

(30) Foreign Application Priority Data

Jan. 27, 2016 (AU) ..... 2016900244
Jan. 27, 2016 (AU) ..... 2016900245
Mar. 30, 2016 (AU) ..... 2016901181

(51) Int. Cl.
*E21B 25/16* (2006.01)
*E21B 25/02* (2006.01)
*E21B 47/01* (2012.01)

(52) U.S. Cl.
CPC ..... *E21B 25/16* (2013.01); *E21B 25/02* (2013.01); *E21B 47/01* (2013.01)

(58) Field of Classification Search
CPC ..... E21B 25/16; E21B 25/02; E21B 47/01
See application file for complete search history.

(56) References Cited

U.S. PATENT DOCUMENTS 5,230,387 A * 7/1993 Waters ..... E21B 47/0228 175/45
5,267,620 A * 12/1993 Lee ..... E21B 23/02 175/246

(Continued)

OTHER PUBLICATIONS

Boart Longyear Global Product Catalog for "Geotechnical and Environmental Drilling Equipment," published Nov. 1, 2001 (entire binder insert being submitted; relevant sections include 7.13 and 7.18).†

*Primary Examiner* — Christopher J Sebesta
*Assistant Examiner* — Neel Girish Patel
(74) *Attorney, Agent, or Firm* — Felix L. Fischer

(57) ABSTRACT

A system (10) and method (50) of enabling the acquisition of borehole survey data and core orientation data in a single instrument trip in a core drill (12) having a drill string (18) and an inner core barrel assembly (16). The method uses a borehole survey tool 14 that is arranged to at least log its position in three-dimensional space. The borehole survey tool (14) is run down the drill string (12) in which the inner core barrel assembly (16) is installed. The inner core barrel assembly (16) is arranged to either provide or facilitate detection of an indication of tool face of a core sample (24) held in the inner core barrel assembly (16). The indication of tool face is then transferred mechanically or electronically to the visiting borehole survey tool (14).

13 Claims, 17 Drawing Sheets

(56) References Cited

U.S. PATENT DOCUMENTS

| | | | | |
|---|---|---|---|---|
| 6,158,534 | A * | 12/2000 | Fanuel | E21B 25/00 175/403 |
| 6,341,656 | B1 * | 1/2002 | Fanuel | E21B 10/48 175/244 |
| 8,333,255 | B2 * | 12/2012 | Drenth | E21B 25/02 175/246 |
| 8,485,280 | B2 † | 7/2013 | Drenth | |
| 2004/0216927 | A1 * | 11/2004 | Beach | E21B 23/04 175/246 |
| 2011/0079436 | A1 * | 4/2011 | Drenth | E21B 25/02 175/58 |
| 2014/0174828 | A1 * | 6/2014 | Muntz | E21B 25/02 175/246 |
| 2015/0029035 | A1 * | 1/2015 | Hejleh | E21B 47/01 340/854.4 |

* cited by examiner
† cited by third party

METHOD AND SYSTEM FOR ENABLING ACQUISITION OF BOREHOLE SURVEY DATA AND CORE ORIENTATION DATA

REFERENCES TO RELATED APPLICATIONS

This application is a national stage filing under 35 U.S.C. 371 and claims priority of International Application serial no. PCT/AU2017/050049 which in turn claims priority of Australian patent application serial no. 2016900244 filed on 27 Jan. 2016, Australian patent application serial no. 2016900245 filed on 27 Jan. 2016 and Australian patent application serial no. 2016901181 filed on 30 Mar. 2016, the disclosures of which are incorporated herein by reference.

TECHNICAL FIELD

A method and system are disclosed for enabling acquisition of borehole survey data and core orientation data in a single instrument trip. Embodiments of the method and system may be used in conjunction with core drilling operations.

BACKGROUND ART

Borehole surveying of a bore being drilled by a core drill and core orientation are conducted in mineral exploration as two separate processes that require a temporary halt in drilling production. A core drill comprises a drill string made up of a number of drill rods and provided with an outer core barrel and a core bit at a downhole end. An inner core barrel assembly is locked into the outer core barrel during drilling for receiving strata cut by the core bit. The inner core barrel assembly provided with a head assembly at and uphole end and a core tube and a downhole end. A spindle assembly enables rotation between the head assembly and the core tube. The purpose of this is to rotationally decouple the core tube from the core drill. This ensures that during core drilling the core tube which receives the core sample is rotationally stationary. After the core drill has drilled a sufficient depth to fill the core tube with cut strata the inner core barrel assembly is retrieved.

Borehole survey tools are run down the drill string when drilling is halted to acquire at least borehole geospatial data in order to ensure that the core drill is following a desired path. The borehole survey tool has an arrangement of sensors to collect inclination, azimuth, axial orientation (tool face) relative to Magnetic/True North and gravity as well as other information. The sensors may be an arrangement of accelerometers, magnetometers, gyroscopes or other devices.

Additionally it is critical for geologists to have knowledge of the in situ orientation of a core sample recovered by the core drill. Many tools and systems are currently available for providing core orientation. Often these require some type of orientation mechanism which is housed in the inner core barrel assembly. This also often requires the use of an extension sub between the end of the drill string and the outer core barrel.

While borehole geospatial position may provide some guide as to core orientation the two orientations are often different. One fundamental reason for this is that the location at which a borehole survey tool takes its deepest borehole data is several meters away from the location from which core orientation data is required. Another reason is that the spindle assembly (and in particular its spindle bearing) in the inner core barrel assembly makes it impossible for the borehole survey tool to acquire reliable tool face from the core tube.

Consequently current practice for surveying is to stop the drilling process and deploy the survey instrument into the borehole by lowering it usually via a wireline through the drill string of the core drill. The survey tool may be attached to an overshot. The same overshot may be subsequently used to retrieve the inner core barrel assembly. Borehole geospatial data is acquired from the survey tool while core orientation data is separately acquired from the core orientation system housed within the inner core barrel assembly.

SUMMARY OF THE DISCLOSURE

In a general sense the idea of the disclosed method and system is to enable or otherwise facilitate the acquisition of both borehole survey data and core orientation data in a single instrument trip. This avoids the need to incorporate core orientation equipment within the inner core barrel assembly. Embodiments of the method and system also enable simultaneous acquisition of borehole data and core orientation data.

In one aspect there is disclosed method of enabling the acquisition of borehole survey data and core orientation data in a single instrument trip in a core drill having a drill string and an inner core barrel assembly having a longitudinal axis, the method comprising: running a borehole survey tool through a drill string in which is installed an inner core barrel assembly wherein the borehole survey tool is arranged to at least log its position in three-dimensional space; enabling the inner core barrel assembly to provide or facilitate detection of an indication tool face of a core sample held in the inner core barrel assembly; and transferring the indication of tool face to the borehole survey tool.

In a second aspect there is disclosed a system for enabling the acquisition of borehole survey data and core orientation data in a single instrument trip in a core drill, the system comprising: a borehole survey tool configured to run through a drill string in which an inner core barrel assembly is installed, the borehole survey tool arranged to least log its position in three-dimensional space; an inner core barrel assembly having a longitudinal axis and arranged to provide, or facilitate detection of, an indication of tool face of a known point on a core sample held in the inner core barrel assembly, the inner core barrel assembly being releasably latchable in the core drill; wherein the borehole survey tool and the inner core barrel assembly are operatively associated with each other to enable a transfer of tool face from the inner core barrel assembly to the borehole survey tool.

In a third aspect there is disclosed an outer core barrel torque decoupling system for a core drill having a drill string and an outer core barrel coupled to a downhole end of the drill string, the outer core barrel torque decoupling system being arranged to couple to and between the drill string and the outer core barrel and having a torque transfer state wherein during drilling torque imparted to the drill string is transferred by outer core barrel torque decoupling system to the outer core barrel; and a torque decoupling state wherein when the drill string is lifted from a toe of a hole being drilled the outer core barrel torque decoupling system rotational decouples the outer core barrel from the drill string wherein the outer core barrel remain rotationally stationary independent of torque in or applied to the drill string.

In a fourth aspect there is disclosed an inner core barrel assembly for use with a drill string of a core drill the inner core barrel assembly comprising:

a coupling mechanism at an up-hole end of the assembly and capable of releasable connection with a retrieval system;

a core tube for receiving a core sample cut by a core drill in which the inner core barrel assembly is installed; and a spindle which is rotationally fixed to the coupling mechanism and the core tube. This In a fifth aspect there is disclosed an inner core barrel assembly for use with a drill string of a core drill the inner core barrel assembly comprising:

a latch assembly;

a spindle which extends through the latch assembly, the latch assembly arranged to latch the spindle in an axially fixed position in and relative to a the drill string;

a core tube for receiving a core sample cut by a core drill in which the inner core barrel assembly is installed, the core tube coupled at a downhole end of the spindle; and a coupling mechanism at an up-hole end of the latch assembly and capable of releasable connection with a retrieval system;

wherein the spindle is rotationally decoupled from the latch assembly and rotationally fixed to the coupling mechanism and the core tube.

In a sixth aspect there is disclosed an inner core barrel assembly for use with a drill string of a core drill the inner core barrel assembly comprising:

a latch assembly arranged to latch the inner core barrel assembly on a landing ring provided within the drill string;

a coupling mechanism at an up-hole end of the latch assembly and capable of releasable connection with a retrieval system; and a core tube for receiving a core sample cut by a core drill in which the inner core barrel assembly is installed, the core tube being rotationally decoupled from the latch assembly and rotationally fixed to the coupling mechanism.

The fourth, fifth and sixth aspects provide inner core barrel assemblies that are particularly well suited to the method and system for enabling the acquisition of borehole survey data and core orientation data in a single instrument trip in accordance with the first and second aspects above. Indeed the fourth, fifth and sixth aspects provide respective embodiments of a rotationally fixed inner core barrel assembly in which a corresponding head assembly and/or coupling mechanism (such as a spear point) is rotationally fixed relative to an associated core tube. These aspects allow the inner core barrel assembly to be rotationally decoupled from a drill string or outer core barrel which it is latched during rotation of the drill string. As a consequence, and assuming there is no relative rotation between a core sample and a core tube of the assembly which holds the core sample, tool face of the core sample can be transferred to a visiting borehole survey tool while core orientation tool via the coupling mechanism or the head assembly.

In a seventh aspect there is disclosed an integrated borehole payload delivery and retrieval system comprising:

a latch assembly arranged to releasably engage on and inside of a drill string;

a coupling mechanism at an up-hole end of the latch assembly and capable of releasable connection with a retrieval system; and one or both of (a) an upstream payload sub, and (b) a downstream payload sub wherein the upstream payload sub is located between the latch assembly and the coupling mechanism and the downstream payload sub is located downstream of the latch assembly.

In an eight aspect there is disclosed a head assembly comprising:

a latch assembly capable of latching the head assembly in an axially fixed position in and relative to an outer conduit;

an inner tube which extends through the latch assembly the inner tube having a downstream end which is downstream of the latch assembly and an upstream end which is upstream of the latch assembly; and a valve system enabling control fluid flow through the inner tube.

In a ninth aspect there is disclosed an inner core barrel assembly for use with a drill string of a core drill the inner core barrel assembly comprising:

a core tube; and a latch assembly provided with a releasable latch to enable latching of the inner core barrel assembly to an inner surface of the drill string, a landing shoulder downhole of the latch and arranged to contact a landing ring coupled to the drill string, and a hanger spring located between the latch and the landing shoulder;

wherein the core tube is downhole of the landing shoulder and the hanger spring is arranged to compress during a core breaking operation to enable a progressive application of core break tension to a core sample retained in the core tube and provide a shock absorbing function when the landing shoulder lands on the landing ring.

The seventh, eighth and ninth aspects stem from consideration of various features of the fourth, fifth and sixth aspects but significantly a not limited to arrangements in which it is necessary for there to be a fixed rotational relationship between the head assembly and/or coupling mechanism and a or the core tube. Indeed in some of these aspects there is no requirement for a core tube at all because the associated aspect is not limited to use in an inner core barrel assembly.

BRIEF DESCRIPTION OF THE DRAWINGS

Notwithstanding any other forms which may fall within the system and method as set forth in the Summary, specific embodiments will now be described, by way of example only, with reference to the covering drawings in which.

DETAILED DESCRIPTION OF SPECIFIC EMBODIMENTS

Figure 1A:
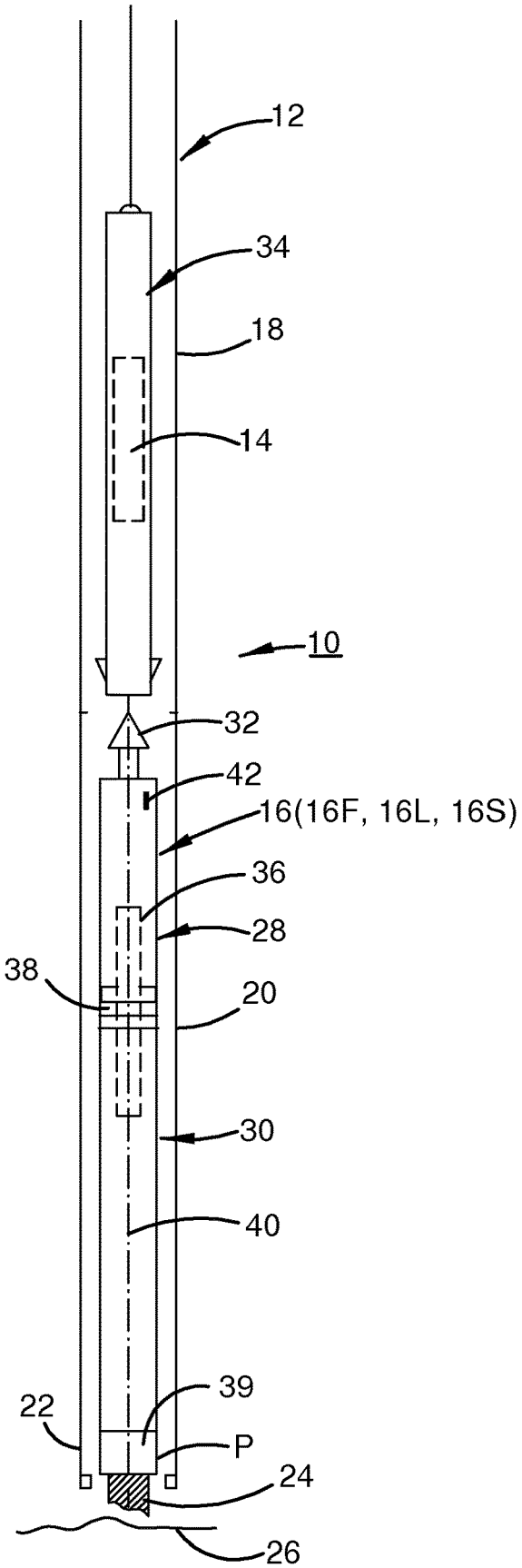
FIG. 1*a* is a schematic representation of an embodiment of the disclosed system for enabling the acquisition of borehole survey data and core orientation data in a single instrument trip.

FIG. 1 is a schematic of an embodiment of the disclosed system 10 for enabling the acquisition of borehole survey data and core orientation data in a single instrument trip. The system 10 is deployable in a core drill 12 and comprises the combination of a borehole survey tool 14 (shown in phantom) and an inner core barrel assembly 16.

The core drill 12 comprises a drill string 18 which is made from a plurality of end to end coupled drill rods. An outer barrel 20 is fitted to a downhole end of the drill string 18. A drill bit 22 is coupled to a downhole end of the outer barrel 20. The inner core barrel assembly 16 is releasably latched to the inside of the outer barrel 20. When the core drilled 12 is in operation the bit 22 cuts a core sample 24 from the in situ strata 26. The core sample 24 progressively feeds into and is held in the inner core barrel assembly 16.

In each of the described embodiments of the system 10 the inner core barrel assembly 16 comprises a head assembly 28 and a core tube 30. The head assembly 28 is arranged to latch onto the outer barrel 20. A coupling mechanism in the form of a spear point 32 extends from an end of the head assembly 28 for connection with an overshot 34. When the core drill is in use the core 24 being cut enters and is retained within the core tube 30.

Also in each described embodiment of the system 10 the inner core barrel assembly 16 is arranged to provide, or facilitate the detection of, tool face of a known point P on or transferable to the core sample 24. The point P is an indicia e.g. a mark physically applied on or otherwise made in, the core tube 30 and/or the associated core lifter assembly 39. Once the inner core barrel assembly 16 is retrieved the location of the point P can be transferred in any conventional manner onto the core sample 24 for example by use of a pencil or scribe. As will be understood by those skilled in the art, provided there is no rotational slippage between the inner core tube 30 and the core sample 24 the tool face of core sample 24 and the rotational location of point P are one and the same. Moreover even if there is relative rotational movement between the core sample 24 and the core tube 30, provided that at rotational movement is known or can be acquired, then tool face can be derived from the rotational position of the point P.

In one embodiment of the system 10 the head assembly 28 has a fixed rotational position relative to the core tube 30. Notwithstanding this the core tube 30 remains rotationally decoupled from the drill string 18. In this embodiment of the system 10 the inner core barrel assembly may be referred to or known as a "rotationally fixed inner core barrel assembly 16F".

In another embodiment of the system 10 the head assembly 28 is coupled to the core tube 30 by a lockable spindle 36 (shown in phantom in FIG. 1*a*). The lockable spindle 36 (and associate spindle bearings 38) is arranged to rotationally decouple the head assembly 28 from the core tube 30 when the core drill 12 is an operation cutting a core sample 24. This allows the core tube 30 to stay rotationally stationary while the core drill 12 and head assembly 28 rotate. However the lockable spindle 36 is also arranged to rotationally lock the head assembly 28 to the inner tube 30 during the core breaking operation. Various constructions and operations of the lockable spindle 36 will be described later. In this embodiment of the system 10 the inner core barrel assembly may be referred to or be known as a "lockable spindle core barrel assembly 16L".

In yet another embodiment of the system 10 the inner core barrel assembly 16 is provided with a standard spindle 36 that always operates to allow rotation of the core tube 30 relative to the head assembly 28 about a longitudinal axis 40 of the inner core are assembly 16. This form or type of inner core barrel assembly may be referred to or known as a "standard spindle inner core barrel assembly 16S".

Thus, by way of summary, the different embodiments of the system 10 may incorporate one of the:

rotationally fixed inner core barrel assembly 16F;
lockable spindle inner core barrel assembly 16L; or
standard spindle inner core barrel assembly 16S.

In the remainder of this description the term "inner core barrel assembly 16" is used when describing features or operational characteristics that applies to all forms or types of inner core barrel assembly. On the other hand features or operational characteristics which are specific to a particular form or type of inner core barrel assembly are referenced by the specific item number 16F, 16L or 16S.

The borehole surveying tool 14 used in the system 10 is carried by the overshot 34. While the borehole survey tool 14 is being run down the core drill 12, it may be operated to log at least borehole geospatial data including borehole inclination and azimuth. In this way the borehole survey tool 14 captures data enabling its position in three-dimensional space to be logged. A feature of the system 10 irrespective of the form or type of inner core barrel assembly 16 is that the borehole survey tool 14 will also log inclination, azimuth and tool face when the overshot 34 is either coupled to the inner core barrel assembly 16 via the spear point 32, or at least one near an up-hole end of the inner core barrel assembly 16.

Additionally in the system 10 each form or type of inner core barrel assembly 16 is arranged so that the head assembly 28 and the core tube 30 have a known or otherwise detectable/ascertainable rotational position relative to each other about the longitudinal axis 40 for at least a core orientation period. The core orientation period commences from the time at least immediately before the breaking of the core sample 24 from the strata 26 to a time at which an indication of tool face is transferred to the borehole survey tool 14.

Rotationally Fixed Inner Core Barrel Assembly 16F

In the fixed inner core barrel assembly 16F, the head assembly 28 and the core tube 30 are rotationally fixed to each other. Therefore the head assembly 28 and the core tube 30 always have a known and indeed permanently fixed rotational position about the axis 40 relative to each other. In order to determine the orientation of the core sample 24 the tool face of point P needs to be transferred to or otherwise acquired by the borehole survey tool 14. Four examples of how this can be achieved are as follows:

i. Mechanically keying the borehole survey tool 14 to inner core barrel assembly 16 so that when the overshot 34 couples with the spear point 32 the borehole survey tool 14 has a known and fixed rotational orientation relative to the point P. This may be accomplished by use of a mechanical keying system which can comprise the combination of a mule shoe on the overshot and complementary guide on the inner core barrel assembly 16 which cooperate to ensure a known final rotational position of the overshot 34 relative to the inner core barrel assembly 16. Accordingly the rotational position of the borehole survey tool 14 logged at a time when the overshot 34 is coupled to the spear point 32 has a known and predetermined relationship to the rotational position of point P.

Figure 2:
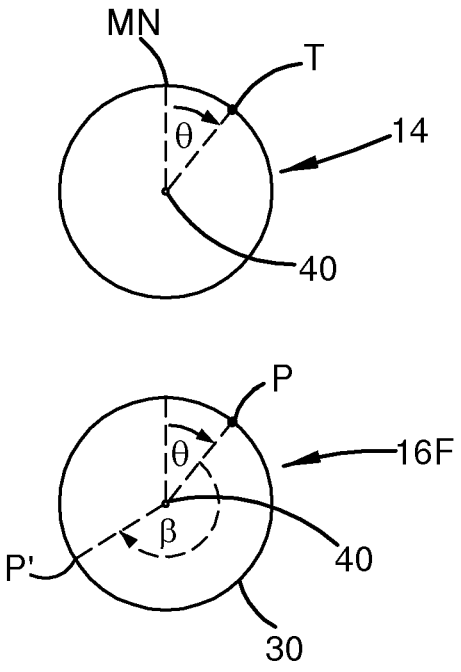
FIG. 2 illustrates possible spatial relationships between respective points on a borehole survey tool and an inner core barrel assembly that may be incorporated in the disclosed method and system.
Figure 3:
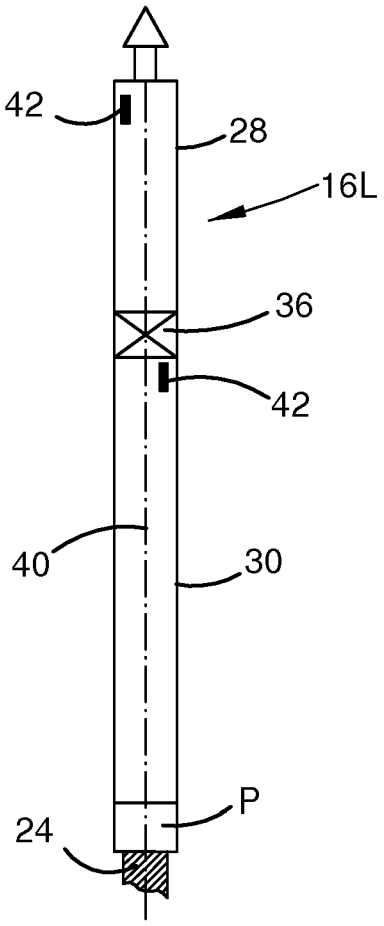
FIG. 3 is a schematic representation of one form of inner core barrel assembly that may be incorporated in an embodiment of the disclosed method and system.

This is illustrated in FIG. 2 which shows a section view through the borehole surveying device 14 and the inner core barrel assembly 16/associated core tube 30. The point T is a known but arbitrary point on the borehole surveying tool 14. As the borehole surveying tool 14 knows or is enabled to log or otherwise determine its three-dimensional location, the rotational position of point T about the axis 40 is known or can be derived. This may be for example with reference to magnetic north (MN) or true north (TN) in vertical boreholes or the Gravity Roll (GVR) position in angled boreholes. The mechanical keying of the borehole surveying tool 14 (via the overshot 34) to the inner core barrel assembly 16 can be arranged so that the point T always axially aligns with the point P upon engagement of the overshot 34 with the spear point 32. Therefore the rotational location of point P about the axis 40 is identical to that of point T.

Figure 1B:
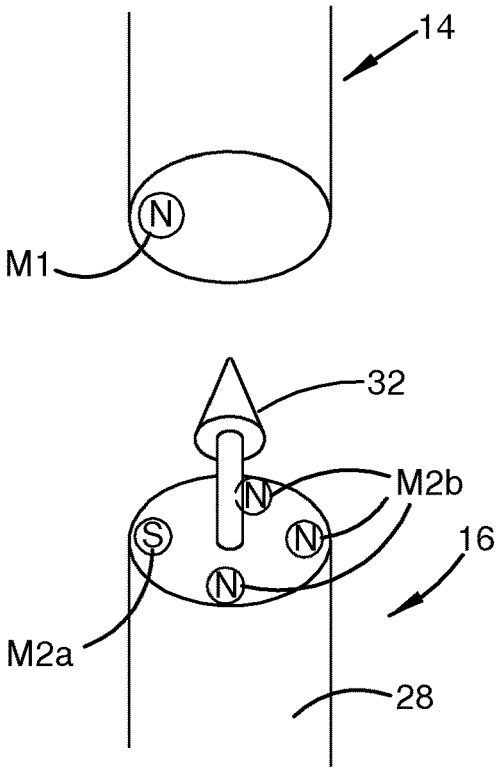
FIG. 1*b* is a schematic representation of a magnetic mule shoe that may be incorporated in an embodiment of the disclosed system for enabling the acquisition of borehole survey data and core orientation data shown in FIG. 1*a;*

As the core 24 is rotationally fixed within the core tube 30 the orientation or tool face of the core sample 24 is effectively transferred by way of the mechanical keying to the borehole survey tool 14. This also holds true even if the point T does not actually align with the point P. All that is required is for there to be a known angular displacement between the point T and the point P when the overshot 34 couples with the spear point 32. For example again with reference to FIG. 2 the point T may be always offset by an angle β from the known point P' on the core sample 24 when the overshot 34 is keyed with the spear point 32. Because the angle β is known and the position of point T is known, the orientation of the core sample 24 is known or can be determined from data acquired by the borehole surveying tool 14.

ii. Magnetically keying the borehole survey tool 14 to inner core barrel assembly 16 so that when the overshot 34 couples with the spear point 32 the borehole survey tool 14 has a known and fixed rotational orientation relative to the point P. With reference to FIG. 1*b*, this can be achieved for example by embedding one or more magnets M1 in the overshot 34 and one or more magnets M2 in the head assembly 28 at respective locations that enable their respective magnetic fields to interact to facilitate a known rotational relationship when the overshot 34 engages with the head assembly 28. FIG. 1*b* depicts the overshot 34 with one magnet M1 having an exposed North Pole, and a head assembly provided with one magnet M2*a* having an exposed South Pole and three magnets M2*b* each having an exposed North Pole. The magnets M2 are spaced by 90° about the axis 40. This facilitates a known spatial relationship where the magnet M1 will align with the magnet M2*a*. To all intents and purposes this is a magnetic equivalent to the mechanical keying described in paragraph (i) above.

iii. Combination mechanical and magnetic keying the borehole survey tool 14 to inner core barrel assembly 16 so that when the overshot 34 couples with the spear point 32 the borehole survey tool 14 has a known and fixed rotational orientation relative to the point P. This is achieved by use of a mule shoe and complementary guide as in paragraph (i) above but with the additional embedding one or more magnets M1 in the overshot 34 or mule shoe; and one or more magnets M2 in the head assembly 28 or guide as in paragraph (ii) above. In this instance the magnets assist in reducing the risk of malfunction of the mule shoe.

iv. An electronically readable or detectable marker 42 (see FIG. 1*a*) may be attached to or embedded in the inner core barrel assembly 16F in axial alignment with (or in a known angular offset position relative to) the known point P. The borehole surveying tool 14 is arranged to communicate with the marker 42 during the core orientation period so that the position of the marker 42 about the axis 40 can be transferred to the core surveying tool 14. In this arrangement the borehole surveying tool 14 may engage with the inner core barrel assembly 16F in any rotational juxtaposition. Upon communication between the marker 42 and the tool 14, the rotational position of the marker 42 relative to a known point T on the tool 14 can be determined. Thus the rotational position of the known point P is again in effect transferred to the borehole surveying tool 14.

Communication between the marker 42 and the tool 14 can be via, but not limited to, short jump communications technology, near field magnetic induction, RF communications, Bluetooth, Wi-Fi, or acoustic communications.

In the fixed inner core barrel assembly 16F, because the head assembly 28 and the core tube 30 are rotationally fixed to each other, rotational decoupling of the entirety of the assembly 16F from the drill string is required in order to ensure that the core sample 24 does not rotate within the outer core barrel 20. Detailed descriptions of embodiments of a rotationally fixed inner core barrel assembly are provided toward the end of this specification.

Lockable Spindle Inner Core Barrel Assembly 16L

As previously mentioned, the lockable spindle inner core barrel assembly 16L is provided with a lockable spindle 36 which acts between the head assembly 28 and the core tube 30. The lockable spindle 36 is a mechanism carried by the inner core barrel assembly 16L that can be activated by a triggering event to lock the rotational position of the head assembly 28 to the core tube 30. The triggering event may be one or combination of but is not limited to:

Physical contact of the borehole surveying tool (via the overshot 34) with the inner core barrel assembly 16L.

Reduction of the rotational speed of the drill string 12 below a coring speed. As a non-limiting example the rotational triggering speed may be say less than 250 RPM.

A period of non-rotation of the drill string 12 for longer than say 30 seconds to 1 minute.

A change (i.e. an increase or a decrease) in fluid pressure within the assembly 16L. For example fluid pressure can be increased to displace splines on the head assembly to engage with recesses on the core tube 30 or an adapter attached to the core tube 30.

Applying tension between the head assembly 28 and core tube 30 which may for example operate a clutch to lock the spindle 36 to the inner core tube.

The detection of the presence or absence of fluid flow to the head assembly 28.

In addition the borehole surveying device 14 may be provided with a timing mechanism which delays taking a log of its location for a period of time such as between 30 seconds to 1 minute after the triggering event.

The lockable spindle 36 may be arranged so that it remains locked after the expiration of the core orientation period and is only unlocked after the inner core barrel assembly 16L is retrieved from the drill string 12. Alternately the lockable spindle 36 may be arranged so that it unlocks after the expiration of the core orientation period thereby allowing relative rotation about the axis 40 of the head assembly 28 relative to the core tube 30.

Irrespective of whether the spindle 36 remains locked or unlocks after the core orientation period the method of acquiring core sample tool face remains the same. What is required is an electronic marker 42 similar to that referred to and described above in relation to the rotationally fixed assembly 16F but for the assembly 16L the electronic marker 42 is required to be on or in a portion of the inner core barrel assembly 16 that has a fixed rotational position with respect to the know point P and core sample 24. Thus the marker 42 may be provided on or in the core tube 30. In this embodiment the marker 42 also has a known rotational relationship with the known point P. Ideally the electronic marker 42 is in axial alignment with the point P.

However a further option when the system 10 incorporates the lockable spindle 36 is to provide a second electronic marker 42*r* on a portion of the core barrel assembly 16L that rotates with the drill string 12 or is otherwise up hole of the spindle bearings 38 i.e. on or in the head assembly 28. The second electronic marker 42*r* operates as a relay device which communicates with the marker 42. The idea here is that the marker 42*r* is able to communicate its rotational position relative to the marker 42 to the borehole surveying tool 14. This may be useful in circumstances or environments where the distance for communication between the borehole tool 14 and the electronic marker 42 may compromise the quality or reliability of the communication. Reducing the communication distance using one or more relay devices enables the acquisition of the rotational position of the known point P provided that every successive hop in communication between adjacent markers also carries with it information regarding the rotational offset about the axis 40 between the successive marker and relays.

Figure 4A:
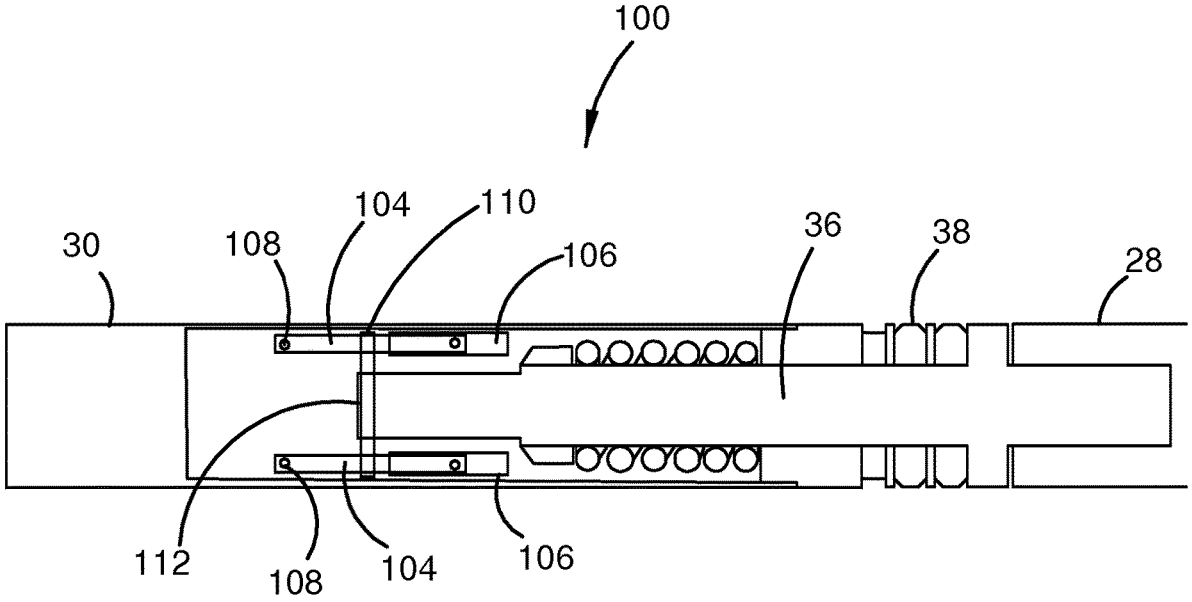
FIG. 4*a* is a schematic representation of a clutch to selectively lock and unlock a spindle that may be incorporated in a second form of inner core barrel assembly that may be used in an embodiment of the disclosed method and system, the clutch being shown in a disengaged state.
Figure 4B:
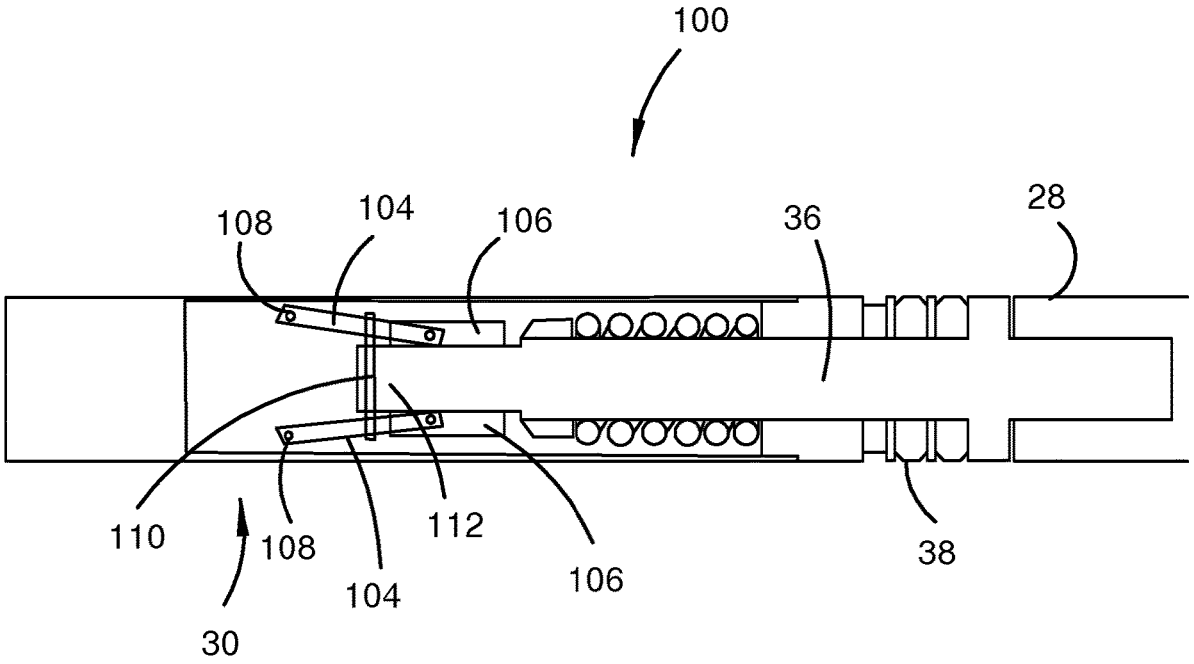
FIG. 4*b* is a schematic representation of the clutch of FIG. 4*a* but in an engaged state.

One example of a locking mechanism that may be used in the lockable spindle inner core barrel assembly 16L is a centrifugal clutch 100 shown schematically in FIGS. 4*a* and 4*b*. FIG. 4*a* shows the clutch 100 in a free state enabling the core tube 30 to rotate relative to the head assembly 28 about the spindle 36. FIG. 4*b* shows the clutch 100 in a locked state in which the core tube 30 is rotationally fixed to the head assembly 28 via the spindle 36. The spindle 36 is fixed at its up hole end to the head assembly 28 and coupled at its down hole end, across the spindle bearings 38 to the core tube 30.

FIG. 4*a* shows the centrifugal clutch 100 having a pair of pivotable clutch arms 104 provided with respective clutch pads 106. The arms 104 are fixed by pivot pins 108 to the core tube 30. A resilient member 110 acts to bias the arms 104 pivot about pins 108 toward and to grip a lower end 112 of the spindle. When the drill is rotating at a speed at least above a threshold speed (for example but not limited to 250 RPM) centrifugal force holds the clutch arms out against the bias of the member 110 as shown in FIG. 4*a*. Thus the spindle is free and the core tube is rotationally decoupled from the head assembly 28. In this configuration which will exist during a coring operation the head assembly 28 rotates with the drill string 20 but the inner core tube 30 is rotationally stationary allowing it to accept the drilled core sample 24 without damaging it.

When rotational speed of the drill string drops below the threshold speed (such as would occur prior to a core breaking operation) the clutch arms 104 are pivoted toward the spindle 36 by action of the resilient member 110 so that clutch pads 106 engage the end 112 of the spindle 36. This effectively locks the inner core tube 30 to the head assembly 28. This mode would occur at the end of a core run and allow the core orientation data from the visiting tool 14 (or indeed from a core orientation tool situated above a traditional landing ring and bearing assembly 38 of inner core barrel assembly 16) to be transferred accurately and reliably to the core sample locked in the inner core tube 30.

In a variation of this the up-hole ends of the clutch arms 104 could be pivotally connected to the spindle 36*c* rather than to the inner core tube 30 and a rod or other member is provided in the inner core tube 30. The resilient member 110 would act to bias the arms and pads 106 onto this rod when the spindle 36 (i.e. the drill string) is not rotating or at least rotating below a threshold speed thereby effectively locking the inner core tube 30 to the head assembly. When the drill string is rotating above the threshold speed the centrifugal force overcomes the bias of the resilient member thereby releasing from the rod and allowing relative rotation between head assembly 28 and the inner core tube 20.

Other rotation speed sensitive (i.e. centrifugally activated) actuators can be used to selectively engage and disengage a variety of clutches for the purposes of selectively locking an unlocking the spindle. These include for example the centrifugal actuators 16 and 16*a* describe in Australian application number 2012222852 the contents of which is incorporated herein by way of reference.

Standard Spindle Inner Core Barrel Assembly 16S

The transfer of tool face of the core sample 24 to the borehole surveying device 14 for the standard spindle inner core barrel assembly 16S is identical to that described above in relation to the lockable assembly 16L. In the simplest form a first marker 42 is required on or in the core tube 30 (i.e. below the spindle bearings 38) having a known rotational relationship to the known point P. As before ideally this relationship is one of axial alignment. Communication between the marker 42 and the borehole surveying device 14 occurs during the core orientation period. One or more second electronic markers 42*r* may be provided up hole of the spindle bearings 38 on or in the head assembly 28 to relay data between the marker 42 and the borehole surveying device 14.

The core orientation period is the time during which the borehole surveying device 14 acquires orientation data pertaining to the core sample 24. In practical terms this period will be after rotation of the drill string 12 has been halted at the end of a core run until the borehole surveying tool 14 has arrived to a location in the drill string where it is able to acquire the core sample tool face. This period of time includes the period of time in which core break occurs. Thus at a minimum the core orientation period commences from the time at least immediately before the breaking of the core sample 24 from the in situ strata 26 to the time when the borehole surveying device 14 has polled or otherwise communicated with the markers 42 and/or relays 42*r* to acquire the required tool face indication.

In the above described embodiments of the system 10 which utilise the assembly 16L or 16S a plurality of electronic markers 42 may be provided below the respective spindle bearings 38 for example on or in the core tube 30, or indeed on or in a core catcher assembly 39 coupled to an end of the core tube 30. The provision of multiple markers 42 may be particularly advantageous where the markers 42 are "dumb" markers in the sense that they do not have any ability to determine their own position in three-dimensional space. In such embodiments the markers 42 have a fixed and known spatial relationship to the known point P. The markers 42 may also be arranged so as to communicate at different frequencies or with otherwise different signatures to the borehole surveying device 14. In this way data/signals can be acquired from the plurality of markers 42. In turn this can enable the use of various algorithms and signal processing such as for example triangulation to facilitate acquisition, or improved accuracy in the acquisition, of the location of point P, and thus core sample tool face.

For example there may be three or six markers 42 on the core tube 30 arranged in either a circular path a spiral path about the axis 40. Some or all of the markers 42 may also respond with different frequencies or signatures. Thus now there is a set of markers 42 that have different but known rotational, or a combination of both rotational and axial, offset from the known point P and communicate with different frequencies. The axial offset (when arranged in a spiral path) may enable different signal strengths received from the markers 42 to be used to assist in acquiring core sample tool face.

Alternately the above described arrangement can be reversed so that there is say one marker 42 below the spindle bearings but multiple sensors at know positions on the survey tool 14 to enable use of triangulation or other algorithms to facilitate transfer of tool face.

In a further variation particularly where a single marker 42 is used in the assembly 16L, or 16S the marker 42 may be a "smart" marker which incorporates position sensors and is able to acquire or otherwise determine its own location in three-dimensional space. In such an instance the smart marker 42 can then communicate its location to the visiting borehole surveying device 14 during the core orientation period. Indeed it is possible to have both one or more "dumb" markers 42 and a smart marker. This provides a degree of redundancy and self-checking ability.

Figure 5:
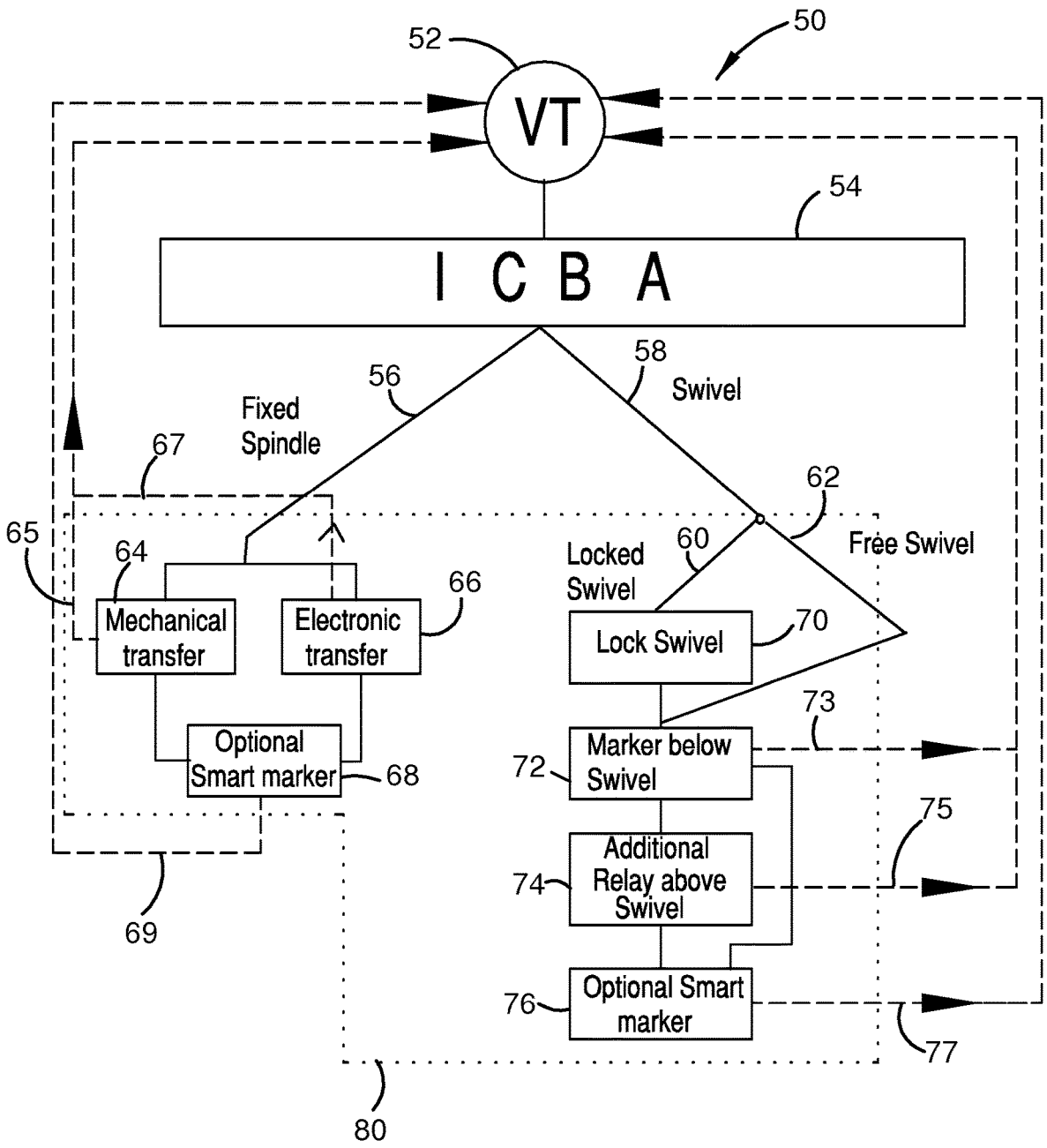
FIG. 5 is a flow diagram illustrating possible steps in various embodiments of the disclosed method of enabling acquisition of borehole survey data and core orientation data in a single instrument trip.

FIG. 5 is a flowchart showing in broad terms embodiments of the method 50 of enabling the acquisition of borehole so survey data and core orientation data in a single instrument trip. The method 50 requires two fundamental steps:

52—running a borehole survey tool 14 through a drill string; and

54—enabling an inner core barrel assembly 16 to provide or facilitate detection of tool face of a core sample 24 held in the inner core barrel assembly 16.

In performing step 52 the borehole survey tool 14 is arranged to at least log its position in three-dimensional space.

Steps 52 and 54 are fundamental as the method 50 requires interaction between the borehole survey tool 14 and the inner core barrel assembly 16. Thus both need to be adapted or otherwise configured to interact and communicate with each other. This interaction and communication may be mechanical, electronic, or in many instances both mechanical and electronic.

Different embodiments of the method 50 are dependent on the type or form of inner core barrel assembly 16. When a rotationally fixed inner core barrel assembly 16F as described above is used the method proceeds along path 56. If the core barrel assembly incorporates a swivelling spindle the method proceeds along path 58. The path 58 branches to: the path 60 in the event that the spindle is lockable such as in the lockable spindle inner core barrel assembly 16L; or, the path 62 in the event that the spindle remains free to enable relative rotation between the head assembly and inner core tube such as in the standard spindle inner core barrel assembly 16S.

In the event the method proceeds along path 56 one of two further steps 64 or 66 may be taken. At step 64 tool face of the core sample 24 (i.e. the rotation position of the known point P about the axis 40) is transferred to the visiting borehole survey tool 14 by way of the mechanical keying of the borehole survey tool 14 and in particular the corresponding overshot 34 to the inner core barrel assembly 16F in the manner described above. This is represented by the path 65.

In the alternate step 66 tool face is transferred electronically to the visiting borehole survey tool 14 via the electronic marker 42. This is represented by the path 67.

An optional step 68 of transferring tool face is available when a "smart" electronic marker or device is used in the inner core barrel assembly 16F which is able to determine its own location in three-dimensional space. In this step the "smart" electronic marker communicates its location to the visiting borehole survey tool 14 via an electronic or otherwise wireless communication system. This is represented by the path 69.

When the method 50 incorporates an inner core barrel assembly having a lockable spindle, the method proceeds along path 58 and 60 to step 70 at which the lockable spindle is locked. As previously described above many different mechanisms and systems can be used to lock the spindle.

Subsequently tool face can be transferred to the visiting borehole survey tool 14 at step 72 by one or more electronic markers 42 located below the spindle. This transfer may be directly from the marker 42 as represented by path 73. Alternately if the inner core barrel assembly 16 is provided with one or more relay markers 42*r* then the transfer may be via these relay markers as represented by path 75.

The optional step 76 of transferring tool face is available when a "smart" electronic marker or device is used in the inner core barrel assembly 16L/16S. In this step the "smart" electronic marker communicates its location to the visiting borehole survey tool 14 via an electronic or otherwise wireless communication system. This is represented by the path 77. It is further possible for the optional "smart" marker to communicate to the visiting borehole survey tool 14 via the relay markers 42*r* if they are provided in the inner core barrel assembly 16L/16S.

Irrespective of the form of the inner core barrel assembly 16 the transfer of tool face occurs within the core orientation period. This is represented in FIG. 5 by box 80 within which the steps 64-76 occur.

Thus in summary embodiments of the system 10 and method 50 enable or otherwise facilitate the acquisition of core sample tool face in a single instrument trip (that being of the visiting borehole survey tool 14). This can be achieved without the need to install "smart" orientation devices in the inner core barrel assembly 16. However as indicated above, the option remains to incorporate such "smart" orientation devices to provide redundancy and self-checking capability. This provides benefits in terms of reduced downtime by requiring separate runs to acquire borehole survey data and core orientation data. In addition embodiments of the system 10 and method 50 can avoid the need to place expensive and delicate sensors such as accelerometers, magnetometers and gyroscopes in the inner core barrel assembly which is often subject to very harsh environmental conditions during the drilling process.

Latent rotational torque (LRT) of the drill string is an issue that can adversely affect acquisition of core tool face irrespective of the acquisition method of system. When rotation ceases at the end of a core run, the drill string 12 is traditionally lifted by the drill rig from the bottom of the borehole to allow the inner core barrel assembly 16 which includes the core lifter assembly 39 contained within the outer core barrel 20 to grip the freshly drilled core sample 24, mechanically engage the back of the drill bit 22 and transfer the core breaking load force to the much stronger drill string 12 and break the core sample 24 from the parent rock 26. LRT can build up in the drill string 12 and suddenly release in a rotational action, to cause the freshly drilled core sample 24 to rotationally slip within the core lifter assembly 39 and core tube 30 during the core breaking sequence. This in turn can cause any core orientation data collected just prior to the core break sequence by any back-end non-contact type core orientation tool, to be inaccurate. This problem is exasperated with increased borehole depth.

Figure 6:
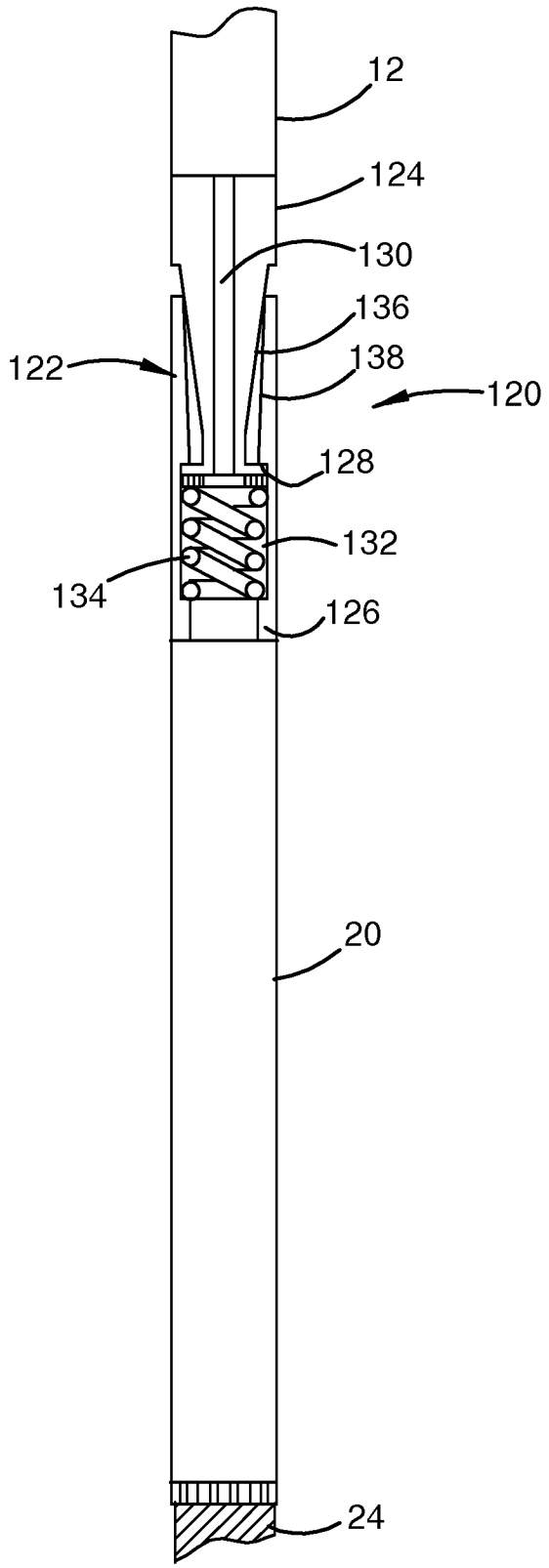
FIG. 6 is schematic representation of an outer barrel clutch that may be used in or with embodiments of the disclosed system for enabling the acquisition of borehole survey data and core orientation data in a single instrument trip.

FIG. 6 provides a schematic representation of an outer core barrel latent rotational torque decoupling system 120 that may be used with the current system 10 and method 50 to reduce adverse effects of LRT on acquisition of core orientation data. The system 120 is coupled between the downhole end of the drill string 12 and the outer core barrel 20. In this embodiment the system 120 is in the form of a hollow clutch sub 122. The sub 122 is in the form of a simple spring loaded taper lock clutch.

The sub 122 has a complementary part 124 which is fixed to the drill string 12 and a second part 126 which is fixed to the outer core barrel 20. The parts 124 and 126 are permanently mechanically coupled together by a piston head 128 which is attached to part 124 and is able to slide within a cylinder 132 formed within the part 126. A hollow section 130 of part 124 allows a traditional inner core barrel assembly to pass through it into outer core barrel 20. The piston head 128 is biased by a spring 134 away from the outer core barrel 20. The part 124 has a conical member 136 while the part 126 has a complementarily shaped conical socket 138.

During drilling when the weight of the drill string is on the toe of the hole the piston 128 which is slidably attached to part 124, slides in a downhole manner through the cylinder 132 so that the surfaces of the conical member 136 and the socket 138 engage each other. This contact transfers torque from the drill string 12 to the outer core barrel 20 causing rotation of the outer core barrel 20 to effect coring.

During a core break operation the drill string 12 is lifted from the toe of the hole. When this occurs the piston 128 attached to part 124 is able to slide in an up-hole direction to separate the member 136 from the surface of the socket 138. Thus now the outer core barrel 20 is rotationally decoupled from the drill string 12. Any latent rotational torque within the drill string 12 is unwound without being transferred to the outer core barrel 20 and the inner core barrel assembly 16 before the core sample 24 is broken away from the in-situ rock 26.

Detailed Description of Inner Core Barrel Assembly

As previously described one of the embodiments of the disclosed method and system for enabling acquisition of borehole survey data and core orientation data in a single instrument trip uses a rotationally fixed inner core barrel assembly 16F. The rotationally fixed inner core barrel assembly 16F may have a head assembly and/or a coupling mechanism to enable retrieval (such as a spear point) which is/are rotationally fixed relative to the core tube. At the same time it is necessary for the inner core barrel assembly to be rotationally decoupled from the drill string/outer core barrel assembly.

The following is a disclosure of various forms of an inner core barrel assembly and an associated head assembly developed by the applicant. The inner core barrel assembly and assembly have many and varied applications and uses, one of these is as a rotationally fixed inner core barrel assembly which is well-suited to the above-described application of enabling the acquisition of borehole survey data and core orientation data in a single instrument trip. However the following described inner core barrel assembly is not limited to application where having a fixed rotational relationship between the spear point and the core tube is critical. The inner core barrel assembly has several unique features and aspect which have application, either by themselves or in various combinations with each other that have application their own right and are independent of the "rotationally fixed" aspect. These features/aspects include, but are not limited to:

- A head assembly having a latch assembly for attaching the head assembly in a conduit such as an outer core barrel, an inner tube that passes through the latch assembly and a valve system that enables the control of fluid flow through the inner tube. The head assembly is not limited to use in an inner core barrel assembly and may be used for example to deploy sensing or measuring equipment inside a drill string.
- An inner core barrel assembly with a hanger spring which enable a progressive application of core break tension during a core breaking operation as well as provide a shock absorbing function when the inner core barrel assembly initially lands on an internal landing ring. This benefits provided by the hanger spring are applicable to the rotationally fixed inner core barrel assembly, a lockable spindle inner core barrel assembly, or a standard spindle inner core barrel assembly.
- An integrated payload and delivery system having a latch assembly arranged to engage an inside of the drill string, the coupling mechanism such as for example a spear point, and one or both of an upstream payload sub which is located between the latch assembly and the coupling mechanism and a downstream payload sub that is located downstream of the latch assembly. This system is not limited all to use for core sampling or retrieving the core sample.

Embodiments of the rotationally fixed inner core barrel assembly 16F are depicted in FIGS. 7*a*-18*a*.

Figure 10A:
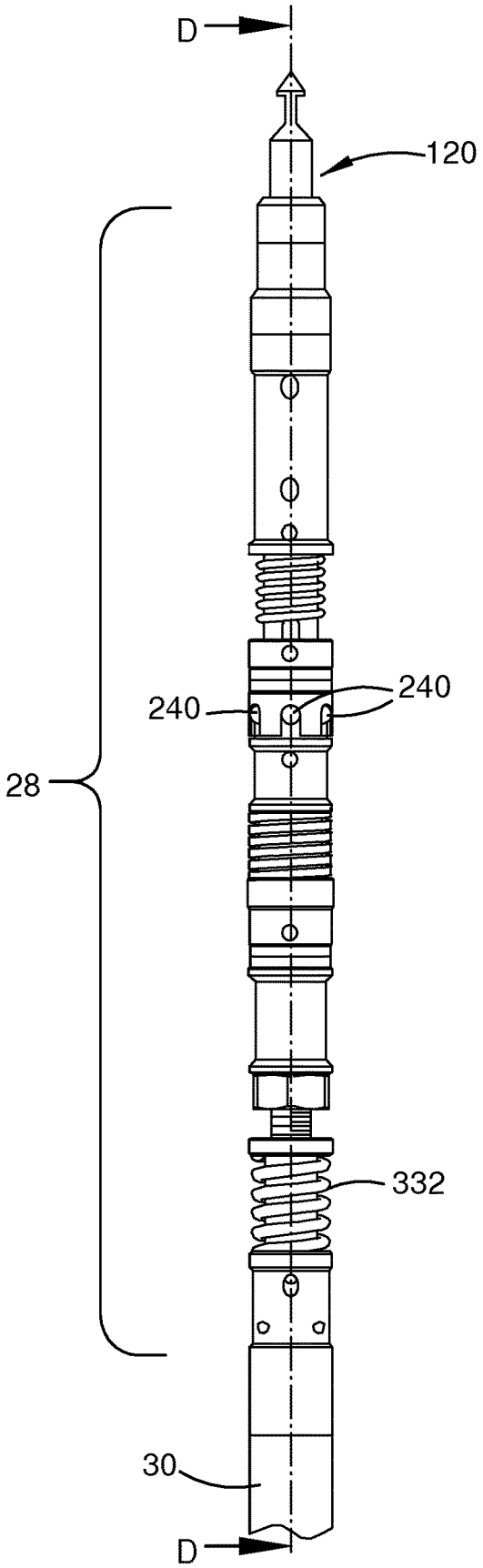
FIG. 10*a* is a front elevation of the rotationally fixed inner core barrel assembly when in a descending mode of operation.
Figure 10B:
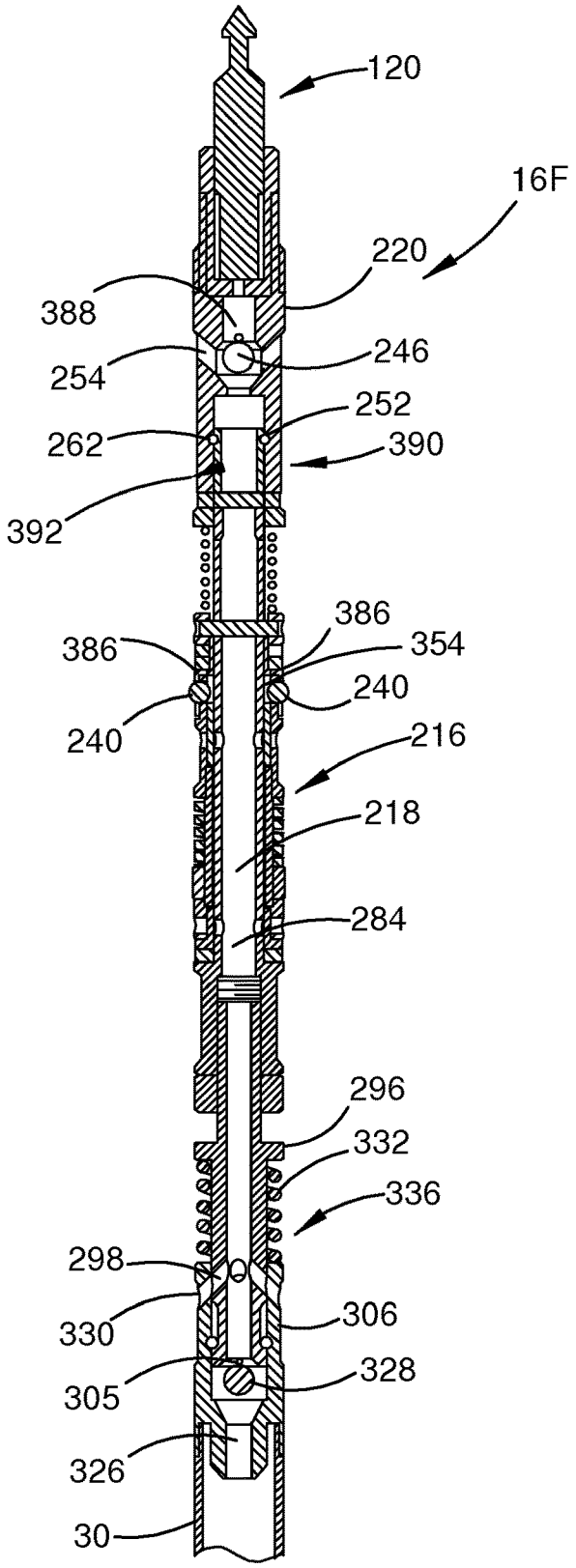
FIG. 10*b* is a section view of the rotationally fixed inner core barrel assembly shown in FIG. 10*a;*

In order to provide initially a broad overview of the present embodiment of the rotationally fixed inner core barrel assembly 16F, references are made to FIGS. 10*a* and 10*b*. FIGS. 10*a* and 10*b* depict the rotationally fixed inner core barrel assembly 16F in a specific mode of operation, namely a descending mode. The differences between the descending mode of operation and other modes of operation will be described in detail later in this specification.

In broad terms the rotationally fixed inner core barrel assembly 16F comprises a head assembly 28 and a core tube 30. The purpose of the head assembly 28 is to latch the inner core barrel assembly 16F to the inside of a drill string and in particular an outer core barrel 20 (shown in FIG. 6*b*) of the drill string. When the head assembly 28 is latched, coring can commence and a cut core is able to enter the core tube 30. Once the core tube 30 is filled with core, drilling ceases and the head assembly 28 is unlatched and the entire assembly 16F is retrieved by an overshot run on a wire line.

The head assembly 28 is composed of a number of different components and subsystems. These include a latch assembly 216, a spindle 218 and a coupling mechanism in the form of a spear point 220. The spindle 218 connects the core tube 30 to the spear point 220 in a rotationally fixed manner. That is, the connection by the spindle 218 prevents any relative rotation of the coupling mechanism/spear point 220 to the core tube 30. However, the spindle 218 is able to rotate relative to the latch assembly 216. Additionally the spindle 218 is axially fixed relative to the latch assembly 216.

When the latch assembly 216 is latched to an outer core barrel of a drill string, the latch assembly 216 is able to rotate with the drill string. However the spindle 218 is rotationally decoupled from latch assembly 216 and therefore the spindle 218 together with the core tube 30 and the spear point 220 remain rotationally stationary. This opens the way for core orientation to be performed in a manner where a visiting tool with orientation capability/functionality can be run down the drill string after the cessation of drilling but prior to a core break in operation in order to acquire core orientation. This is possible because the rotational position of the spear point 220 and the core tube 30 is always maintained by reason of the spindle 218. Therefore core sample tool face can be transferred by the spindle 218 via the spear point 220 or other part of the head assembly 210 above the latch assembly 216 to a visiting core orientation device or other orientating bore hole surveying tool by keying to or otherwise aligning in a known juxtaposition with the inner core barrel assembly 16F. Accordingly there is no longer a need to house a core orientation device or system within an inner core barrel assembly 16. This has benefits in terms of reduced maintenance of the core orientation system as it is no longer subjected to the mechanical vibrations and shock associated with being retained within the assembly 16 during drilling. Also the size and functionality of the core orientation system is not restricted to the size that can fit within the space provided within the core barrel assembly 16.

Each of the individual components and subsystems of the rotationally fixed inner core barrel assembly 16F will now be described in greater detail with reference to FIGS. 7*a*-9*c*.

Figure 7A:
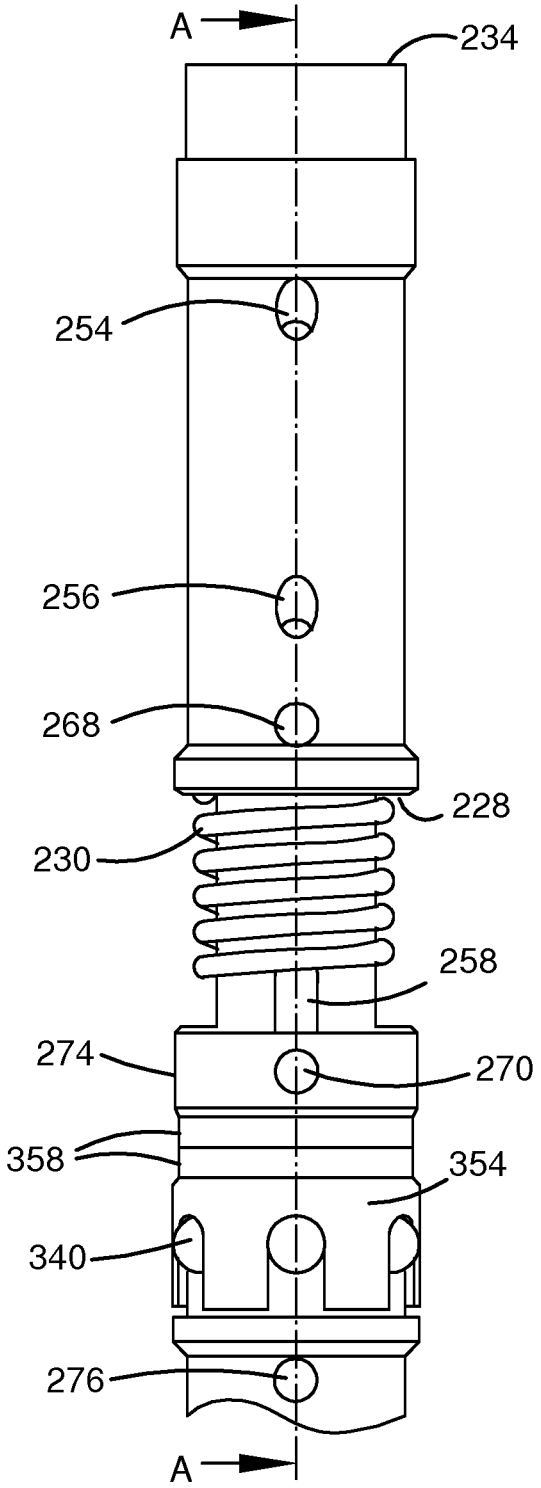
FIG. 7*a* is a front elevation of an upper section of a rotationally fixed inner core barrel assembly that can be used in an embodiment of the disclosed method and system, but can also be used in other applications.
Figure 7B:
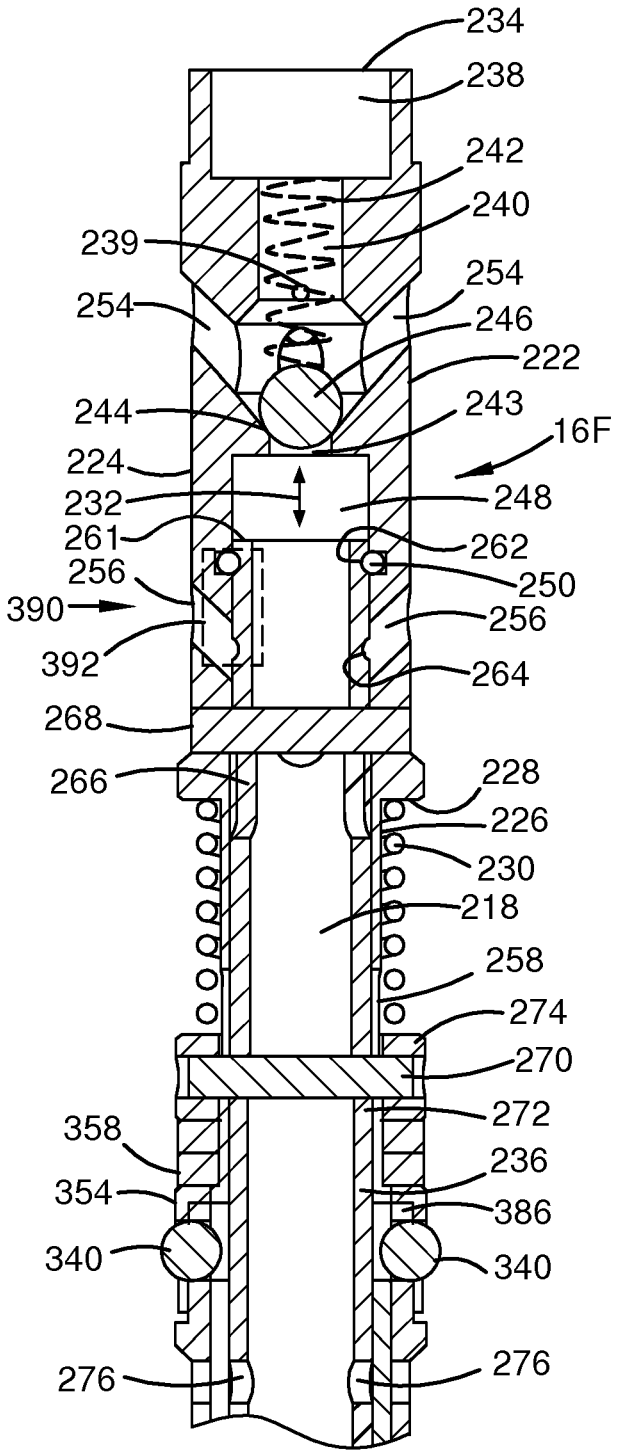
FIG. 7*b* is a section view of the upper section shown FIG. 7*a;*

FIGS. 7*a* and 7*b* depict an upper portion of the rotationally fixed inner core barrel assembly 16F without the spear point 220 (shown in FIGS. 10*a* and 10*b*). The spear point 220 threadingly connects to an upper end of an upper outer valve body 222. The upper outer valve body 222 has an upstream portion 224 and a contiguous downstream portion 226. The downstream portion 224 has a reduced outer diameter in comparison to the portion 226. Additionally the portion 224 has a substantially greater wall thickness than the portion 226. A circumferential shoulder 228 demarks the transition between the portions 224 and 226 and acts as an upper abutment surface for a spring 230.

An axial passage 232 is formed in the valve body 222 which opens onto an up-hole end 234 and a downhole end 236. The passage 232 has a number of contiguous sections of different inner diameter. Immediately adjacent the upper end 234 the passage 232 has a largest inner diameter portion 238. This receives the spear point 220 and/or a payload sub 420 (shown in FIGS. 15*a* and 15*b*). Next there is a reduced diameter portion 240. A valve stop pin 239 extends transversely across the portion 240. This is followed by a reduced diameter portion 243 that forms a valve seat 244 for a valve ball 246.

The portion 240 may optionally incorporate a spring 242 which biases the valve ball 246 onto the seat 244 to restrict the descent speed of the entire rotationally fixed assembly 16F. However in most applications of the rotationally fixed assembly 16F the valve ball 246 would be unrestricted and the spring 240 would not be included and thus maximize the descent speed of the entire assembly. After the portion 243 the passage 232 has a step increase in inner diameter and maintains that diameter to the downhole end 236 except for a circumferential groove 250 which seats a snap ring 252.

The valve body 222 has a plurality of upper diagonal ports 254 between the passage portions 240 and 243; and a further set of ports 256 downhole of the valve seat 244 which open into the portion 248. The body 222 is also formed with a pair of axially extending slots 258. The slots 258 are formed intermediate of the length of the downstream portion 226 of the body 222.

An up-hole portion 260 of the spindle 218 is shown in FIG. 7*b*. This portion of the spindle 218 terminates at an upstream axial end 261 and is formed with two circumferential and axially spaced apart grooves 262 and 264. Downhole of the grooves 264 is a pair of axially extending ports 266. A connecting pin 268 extends transversely through the valve body 222 and the ports 266. In this way the pin 268 couples the spindle 218 to the valve body 222.

A further pin 270 extends transversely through the slots 258 and holes 272 in the spindle 218. Opposite ends of the pin 270 are held within a retaining ring 274. This provides a further coupling between the spindle 218 and the valve body 222. The spring 230 biases the upper valve body 222 way from the latch assembly 216.

Figure 8A:
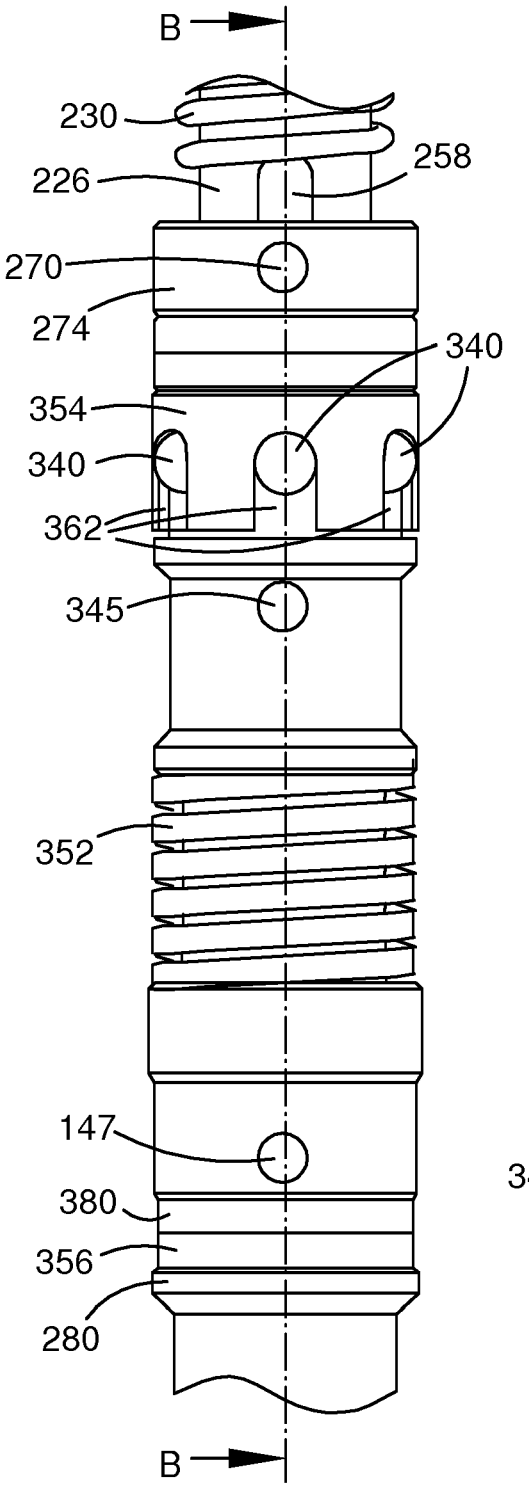
FIG. 8*a* is a front elevation of a middle section of the rotationally fixed inner core barrel assembly.
Figure 8B:
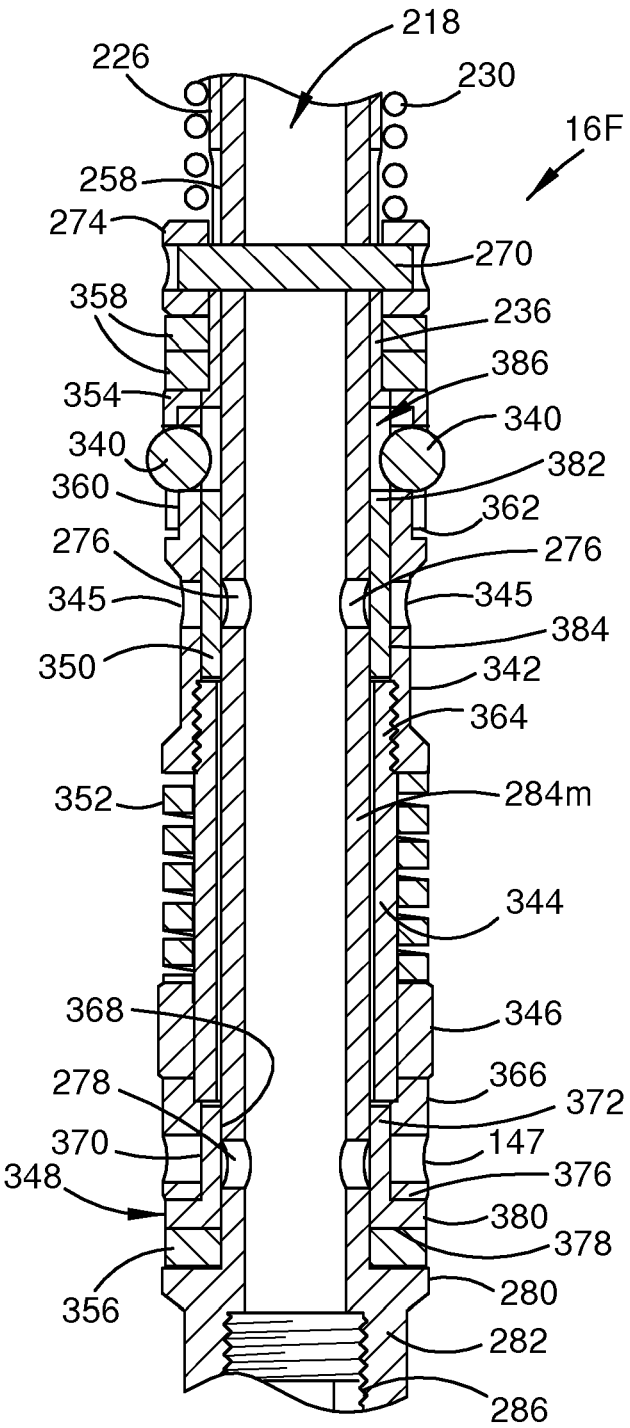
FIG. 8*b* is a section view of the middle section shown FIG. 8*a;*

Continuing in a downhole direction the spindle 218 is provided with a first set of lubrication holes 276 and a second axially spaced set of lubrication holes 278 as shown in both FIGS. 7*b* and 8*b*. The spindle 218 is then formed with a shoulder 280 providing a stepped increase in outer diameter. This also signifies the beginning of an increased wall thickness portion 282 of the spindle 218.

In the disclosed embodiment the spindle 218 is formed with an axial passage 284. As such, the spindle 218 may also be considered to be an inner tube. Further the spindle/inner tube 218 is composed of an up-hole tube portion 218*u* and a downhole tube portion 218*d*. The passage 284 is composed of an up-hole length 284*u* in the tube portion 218*u* and a downhole length 284*d* in the tube portion 218*d*.

The axial passage 284 downstream of the shoulder 280 is formed with an internal screw thread 286. The down-hole tube portion 218*d* is provided with a threaded stem 290 that engages the thread 286. A lock nut 292 locks the downhole tube portion 218*d* at a desired extension from the up-hole tube portion 218*u*.

A flange 296 extends about the downhole tube portion 218*d* downstream of the stem 290. Downstream of the flange 296 a plurality of ports 298 is formed in the circumferential wall of the down-hole tube portion 218*d*. Ports 298 are formed in a circumferential wall of the down-hole tube portion 218*d* and lead to the axial passage 284*d*. Axially extending recesses 302 are formed on the outer circumferential surface of the spindle 218, in the portion 218*d*, near but inboard of its downhole end 304. A transverse stop pin 305 extends across the open end of the passage 288*d*.

The axial passage 284 opens onto the axial opposite ends of the spindle/inner tube 218. This may enable communication between opposite ends of the inner core barrel assembly 10 and in particular between the core tube 30 and the spear point 220/upper valve body 222. Such communication could be for example fluid communication, electronic communication or optical communication. Fluid communication is achieved at the downhole end 304 by virtue of the stop pin 305 which prevents the ball 328 from blocking off fluid flow into the end 304. Fluid communication at the up hole end is achieved by bypass of ball 246 via the larger diameter at the base of ports 254 and the omission of the spring 242 which would otherwise bias the valve ball 246 on the seat 244.

Electronic or optical communication may be facilitated by a small diameter axial hole and groove through and along the length of the wall of the spindle 218 and the use of smaller diameter balls 246 & 328 to allow room for an electronic or optical communication tube/conduit around the balls and fluid communication tube 284. Thus in this arrangement the wall diameter of the spindle 218 may be increased and accompanied by a decrease in the diameter of the valve balls 246 and 328.

Figure 9A:
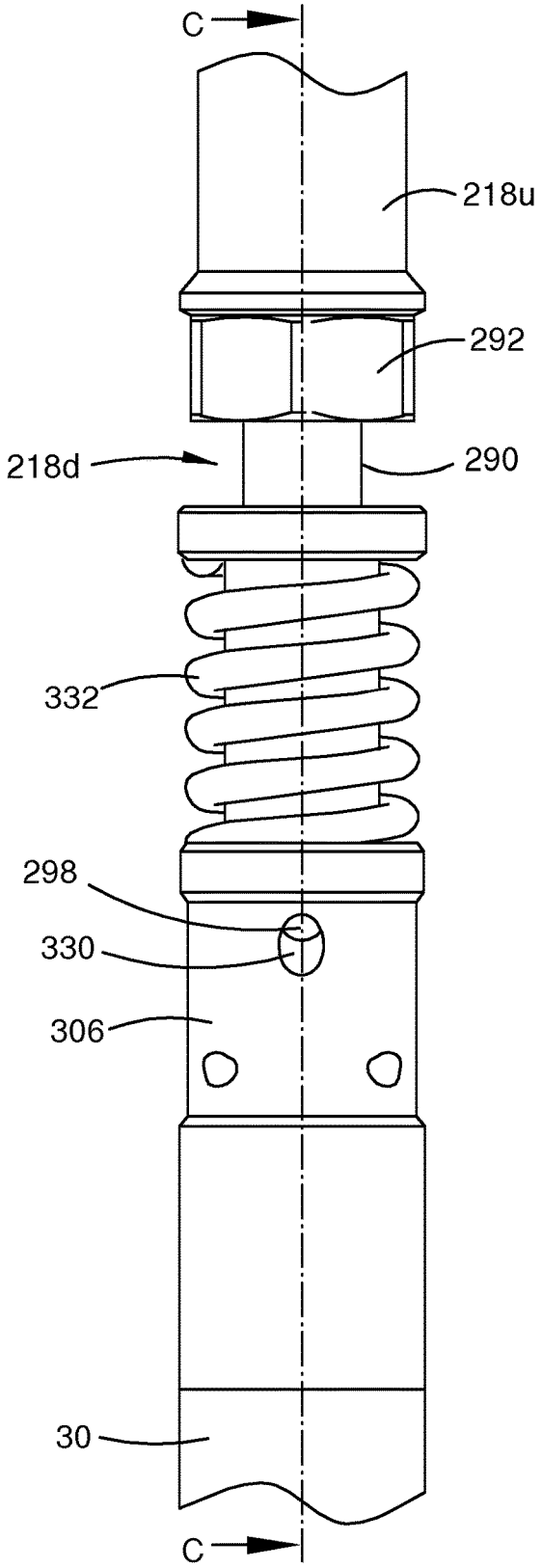
FIG. 9*a* is a front elevation of a lower section of the rotationally fixed inner core barrel assembly.
Figure 9B:
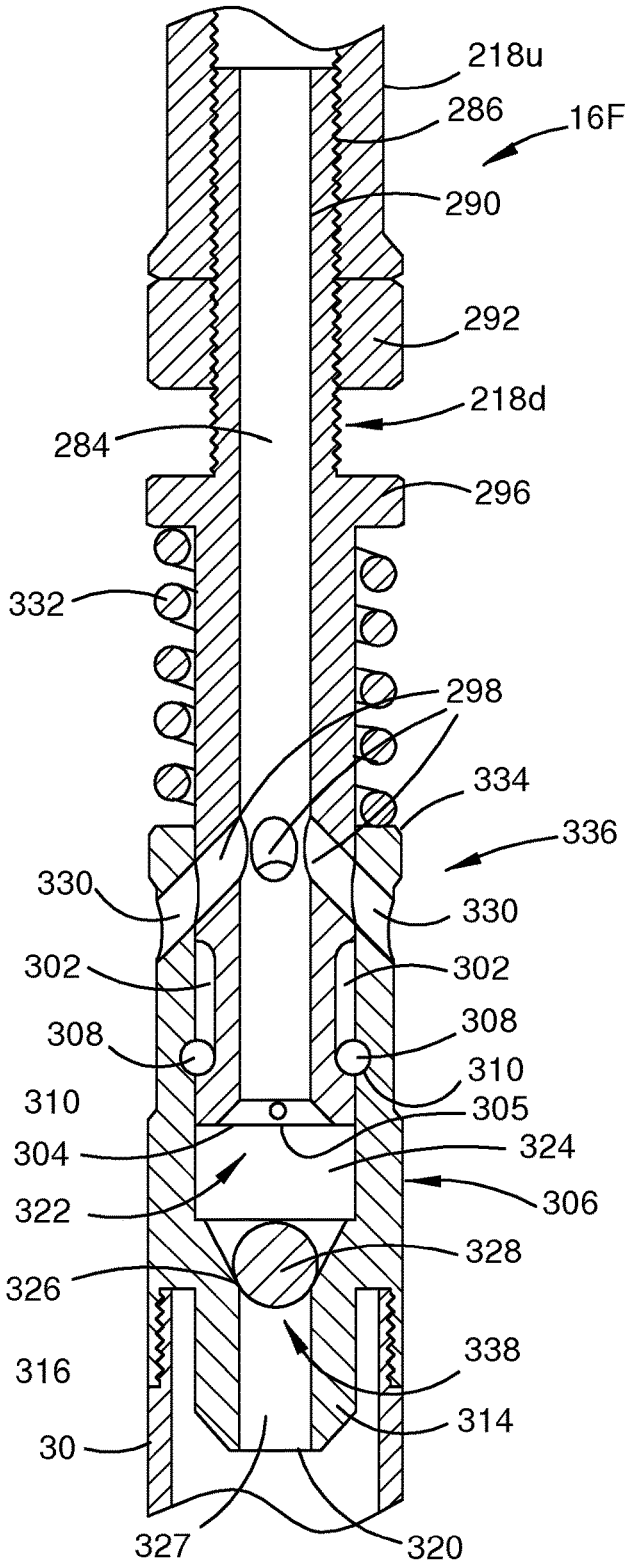
FIG. 9*b* is a section view of the middle section shown FIG. 9*a;*

Referring to FIG. 9*b*, a lower outer valve body 306 is fitted on the downhole end 304 of the spindle 218. The lower outer valve body 306 is retained by at least one roll pin 308 that seat partially within the recesses 302 and partially within a circumferential groove 310 formed on an inner circumferential surface of the valve body 306. The coupling of the lower outer valve body 306 to the spindle 218 via at least one roll pin 308 allows relative axial motion only between the valve body 306 and the spindle 218. The valve body 306 is not able to rotate relative to the spindle 318.

A downhole end of the valve body 306 is provided with a core abutment 314. The core abutment 314 extends along a central axis of the spindle 218 and has an outer circumferential surface 316 that is spaced by an annular gap 318 from an inner circumferential surface of the core tube 30. The outer circumferential surface 316 tapers inwardly so as to reduce in diameter at its axial end 320.

An axial passage 322 is formed in the valve body 306. Passage 322 has a large diameter portion 324 which fits over the spindle 218 and subsequently reduces in diameter to form a valve seat 326 which in turn leads to a reduced diameter passage 327. The valve ball 328 is retained within the valve body 306 between the spindle 218 and the seat 326. Ports 330 are formed in the valve body 306 and open onto the passage 322. A shut-off valve spring 332 is retained between the flange 296 and an up hole end 334 of the valve body 306.

The combination of the valve body 306, ports 298 and 330, and spring 332 form a shut-off valve 336. FIG. 9*b* shows the shut-off valve 336 in an open configuration in which the ports 298 and the ports 330 are aligned with each other to form a continuous flow path between axial passage 284 and an exterior of the rotationally fixed inner core barrel assembly 16F. It will be appreciated that when the lower outer valve body 306 slides in an axial direction relative to the spindle 218 against the bias of spring 332 the ports 298 and 330 will progressively move out of registration and eventually be completely offset from each other. This represents the closed condition or state of the shut-off valve 336.

The valve ball 328 and the valve seat 326 together form an axial flow valve 338. The axial flow valve 338 is configured to open by action of a negative pressure differential between the upstream end 261 and the downstream end 320 to allow fluid to flow into the downstream end in an axial direction from the end 320 opening in the outer body. The axial flow valve 338 closes by action of a positive pressure differential between the upstream end 261 and the downstream end 320 to prevent fluid to flow out of the downstream end 320 in an axial direction.

Turning back to FIGS. 8*a* and 8*b* the latch assembly 216 is composed of a number of parts including: latch members which in this embodiment are in the form of balls 340, a latch body which comprises the combination of an outer sleeve 342 and an inner sleeve 344, landing shoulder 346, a first bearing bush 348, a second bearing bush 350 which is upstream of the first bearing bush 348, a hanger spring 352 which is located between the outer sleeve 342 and the landing shoulder 346, a latch ball cap 354, a downhole bearing washer 356 which is located between the bearing bush 348 and the shoulder 280, and two upstream bearing washers 358 located between the latch ball cap 354 and the retaining ring 274.

The outer sleeve 342 is formed with a number of holes 360 through which the latch balls 340 can partially pass. The latch ball cap 354 is formed with a number of slots 362 of a width smaller than the diameter of the latch balls 340. The slots 362 register with respective holes 360. Thus the latch ball cap 354 prevents the latch balls 340 from falling from the latch assembly 216. A lower end of the outer sleeve 342 threadingly engages the inner sleeve 344. The inner diameter of the inner sleeve 344 is greater than the outer diameter of the adjacent portion of spindle 218. This forms an annular space or gap 364 between adjacent circumferential surfaces of the inner sleeve 344 and the spindle 218.

Lubrication holes 345 are formed on the outer sleeve 342 in radial alignment with the lubrication holes 276. Lubrication holes 347 are formed in a lower portion 366 of the inner sleeve 344. The holes 347 are in radial alignment with the lubrication holes 378.

A lower portion 366 of the inner sleeve 344 is formed with a stepped increase in inner diameter. The first bearing bush 348 has a circumferential bearing surface 368 that extends axially between the lower end 366 of the inner sleeve 344 and the spindle 218. The bearing surface 368 faces the spindle 218. The first bearing bush 348 has an opposite circumferential bearing surface 370 facing the lower end 366 of the inner sleeve 344. The bearing surfaces 368 and 370 are formed on opposite sides of a cylindrical part 372 of the bearing bush 348.

The first bearing bush 348 also has a radial bearing surface 376 on which the inner sleeve 344 bears and an opposite radial bearing surface 378 which faces the washer 356. The bearing surfaces 376 and 378 are on opposite sides of a radial part 380 of the bearing sleeve 348.

The second bearing bush 350 is located between the spindle 218 and the outer sleeve 344 as well as between the in the sleeve 344 and the latch balls 340. The bearing bush 350 is in the form of a cylindrical tube having an inner bearing surface 382 and an outer bearing surface 384. The bearing surface 382 faces the spindle 218 while the surface 384 faces the outer sleeve 342.

The bearing surfaces of the first bearing bush 348 and the second bearing bush 350 can be lubricated by drilling fluids which act as a lubricant and cooling fluid during the drilling process. The drilling fluid is able to freely enter the lubrication holes 276, 278, 345 and 347 to provide the lubricating and cooling function.

Figure 12A:
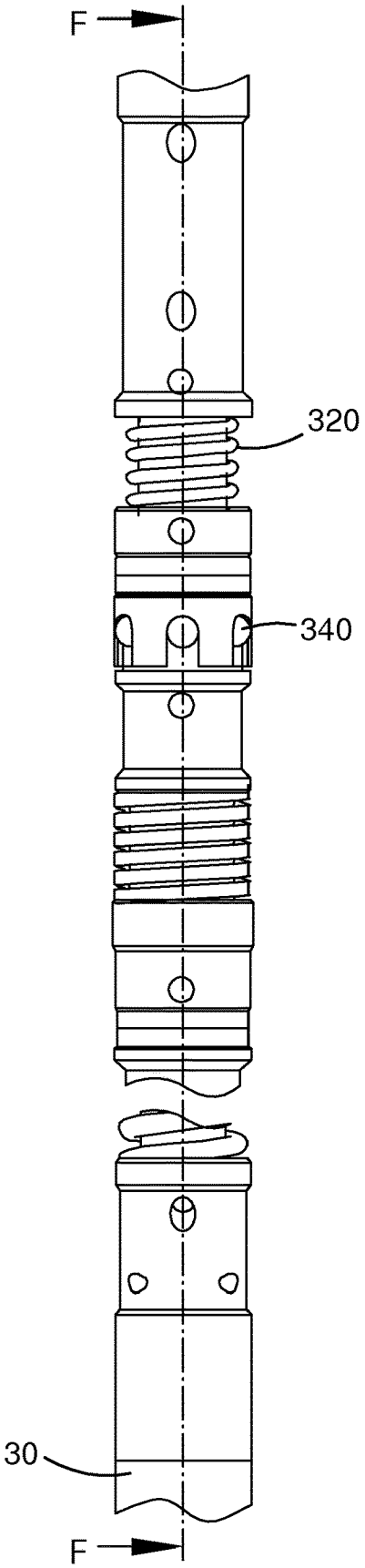
FIG. 12*a* is a front elevation the portion of the head assembly shown in FIG. 11*a* but when in a drilling a mode of operation.
Figure 12B:
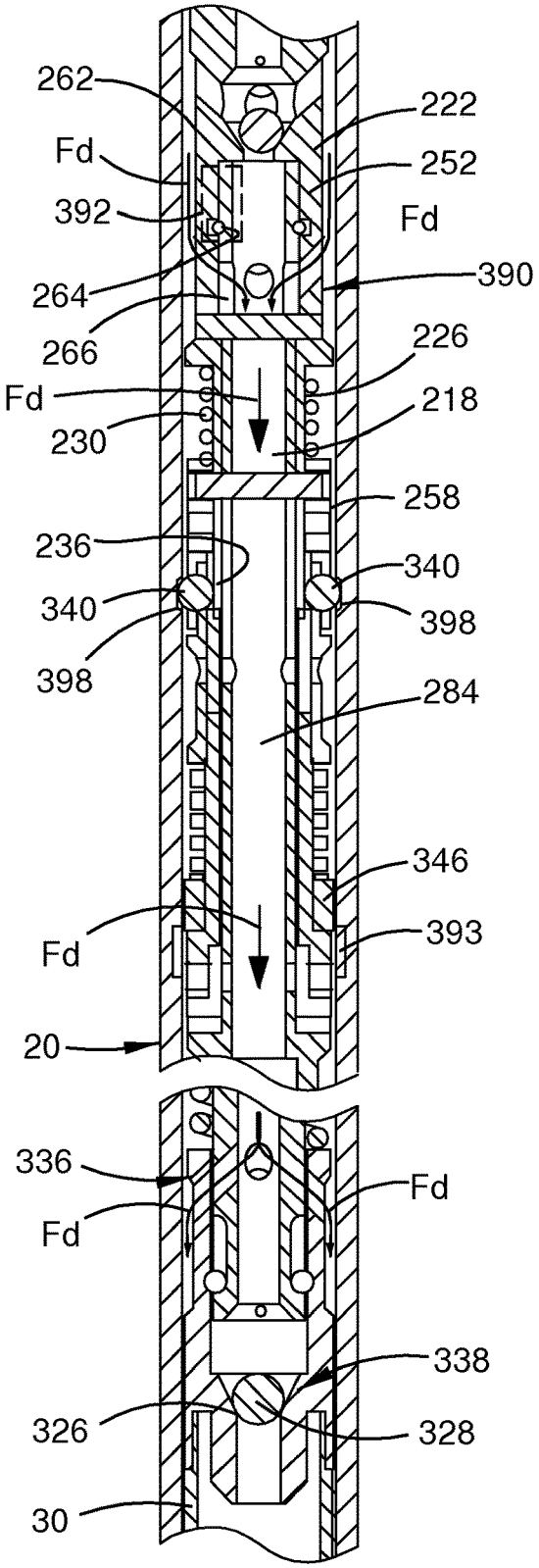
FIG. 12*b* is a section view of the portion of the head assembly shown in FIG. 12*a* when inside an outer core barrel.

The landing shoulder 346 is biased onto the lower end 366 of the inner sleeve 344 by the hanger spring 352. An up-hole end of the hanger spring 352 abuts against a lower end of the outer sleeve 342. It should also be noted that there is an annular gap 386 between an inner circumferential surface of the outer sleeve 342 and the spindle 218 in the region of the holes 360 in which the latch balls 340 are located. The gap 386 is able to accommodate the downhole end 236 of the reduced diameter portion 226 of the upper outer valve body 222 when there is relative axial motion of the valve body 222 toward the core tube 30. Thus the end 236 is able to slide behind the latch balls 340 locking them in a radial outward position into a locking recess 398 provide on the inner circumferential surface of the drill string. This corresponds to the latched position of the latch assembly 216 as shown in FIG. 12*a* and FIG. 12*b*.

In normal drilling mode the latch balls 340 only radially protrude from the latch ball cap 354 sufficiently to prevent an axial up-hole movement of the rotationally fixed assembly 16F during drilling, core block or over drilled core modes, by being of a sufficient radial diameter to engage an upper shoulder of the locking recess 398. This same radial diameter of the latch balls 340 in this mode is not sufficient however to allow the latch balls 340 to engage the greatest internal diameter of the locking recess 398 within the drill string. This minimises friction and wear between the latch balls 340 and the outer drill string; and, the latch balls 340 and the latch body 216 as well as the downhole end 236 of the reduced diameter portion 226 of the upper outer body valve 222. Also as a consequence of the absence of, or at most, a minimal contact between the latch balls 340 and the outer drill string, there is reduced torque transfer between the drill string when rotating and the latch assembly 216. As will be understood this further rotationally decouples the drill string from the spindle 218, core tube 30 and spear point 220. When the end 236 is retracted from the gap 386 the latch balls 340 are free to move radially inward which corresponds to an unlatched position of the latch assembly 216 as shown in FIG. 10*a* and FIG. 10*b*.

Referring to FIG. 7*b* the valve ball 246, valve seat 244 and ports 254 together forms a check valve 388. The check valve 388 (in the absence of the optional spring 242 which would only be incorporated in extreme conditions) is opened and closed by pressure differential between the ports 254 and the downhole side of the seat 244. When the ball is moved off the seat 244 by the pressure differential the upward motion of the ball 246 is limited by contact with pin 239.

The combination of the snap ring 252, the grooves 262 and 264, ports 256 and ports 266 together forms a bistable valve 390. Additionally the combination of the snap ring 252 and the grooves 262 and 264 may be considered as forming a detent system 392 of the bistable valve 390.

In FIG. 7*b* the bistable valve 390 is shown in the closed or shut position. In this position the ports 256 are closed at their radial inner end by the outer surface of the spindle 218. The bistable valve 390 can be opened by sliding the outer valve body 222 axially in a downhole direction relative to the spindle 218. This is shown for example in FIG. 12*b*. When this relative axial motion occurs the ports 256 register with the ports 266 to now provide a flow path between the exterior of the upper outer valve body 222 and the axial passage 284 of the spindle 218.

As will be explained in greater detail shortly such axial motion can be induced by a positive pressure differential between upstream and downstream ends of the rotationally fixed assembly 16F. The positive pressure must be sufficient to open the snap ring 252 so that it moves out of the groove 262, as well as compress the spring 230. When the bistable valve 390 is moved to the open position the snap ring 252 seats in the groove 264 and the lower end 236 extends into the annular gap 386 holding the latch balls 286 in a radial outward position effectively activating the latch assembly 216.

The combination of the check valve 388 and the bistable valve 390 form an upstream valve arrangement 392 of the inner core barrel assembly 10. The upstream valve arrangement 392 together with the shut off valve 336 forms a valve system of the head assembly 28. The valve system controls the flow of fluid through the spindle/inner tube 218.

The operation and functionality of the rotationally fixed inner core barrel assembly 16F will now be described with particular reference to FIGS. 10*a*-14*b*.

Descending Mode

FIGS. 10*a* and 10*b* show the rotationally fixed inner core barrel assembly 16F in a descending mode. The descending mode is the mode of operation when the rotationally fixed inner core barrel assembly 16F is being delivered through a drill string for latching in the outer core barrel 20 (FIG. 12*b*) prior to a core run.

In the descending mode the bistable valve 390 is held in the shut or closed position by the detent system 392 which was activated at the surface by pulling the upper outer valve body 222 away from the spindle 218 so that the snap ring 252 seats in the upper groove 262. Also the shut off valve 336 is held open by action of the shut off valve spring 332 biasing the lower valve body 306 away from the flange 296. In this condition the ports 298 and 330 are in mutual registration and the valve ball 328 is free to move between the valve seat 326 and the pin 305. Additionally in the descending mode the latch balls 340 are free to move in a radial inward direction into the gap 386. This allows the latch balls 340 to retract inwardly if they contact anything so that they do not extend radially beyond the outer circumferential surface of the latch ball cap 354.

As the rotationally fixed inner core barrel assembly 16F descends through the drill string, fluid be it air or water is thus able to travel up the core tube 314 past the valve seat 326 and valve ball 328 through the passage 284 and open the check valve 388 (against the bias of the spring 242 if the spring 242 has been installed), so as to flow outwardly through the ports 254. Thus the valve arrangement enables fluid flow through the rotationally fixed inner core barrel assembly 16F thereby assisting in the rate of descent the assembly 16F will travel through the drill string.

Pumped In/Landed Mode

Figure 11A:
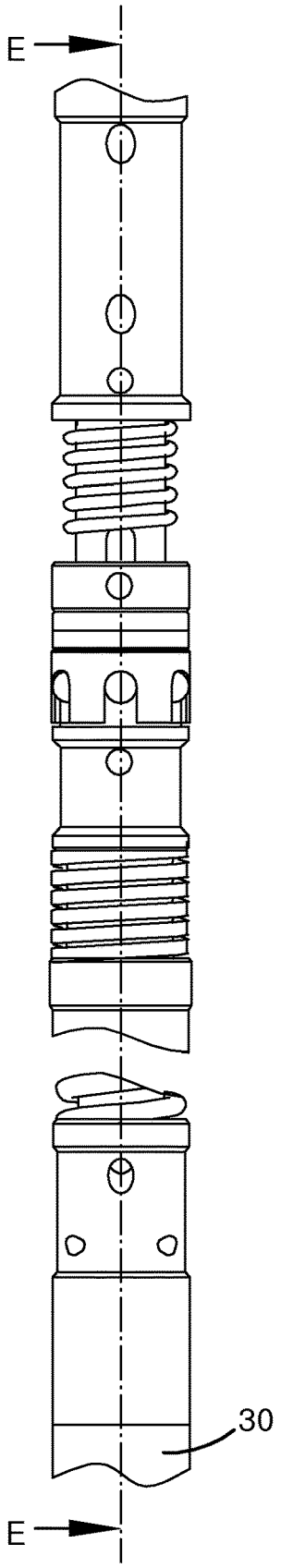
FIG. 11*a* is a front elevation of a portion of a head assembly of the rotationally fixed inner core barrel assembly when in a pumped in mode.
Figure 11B:
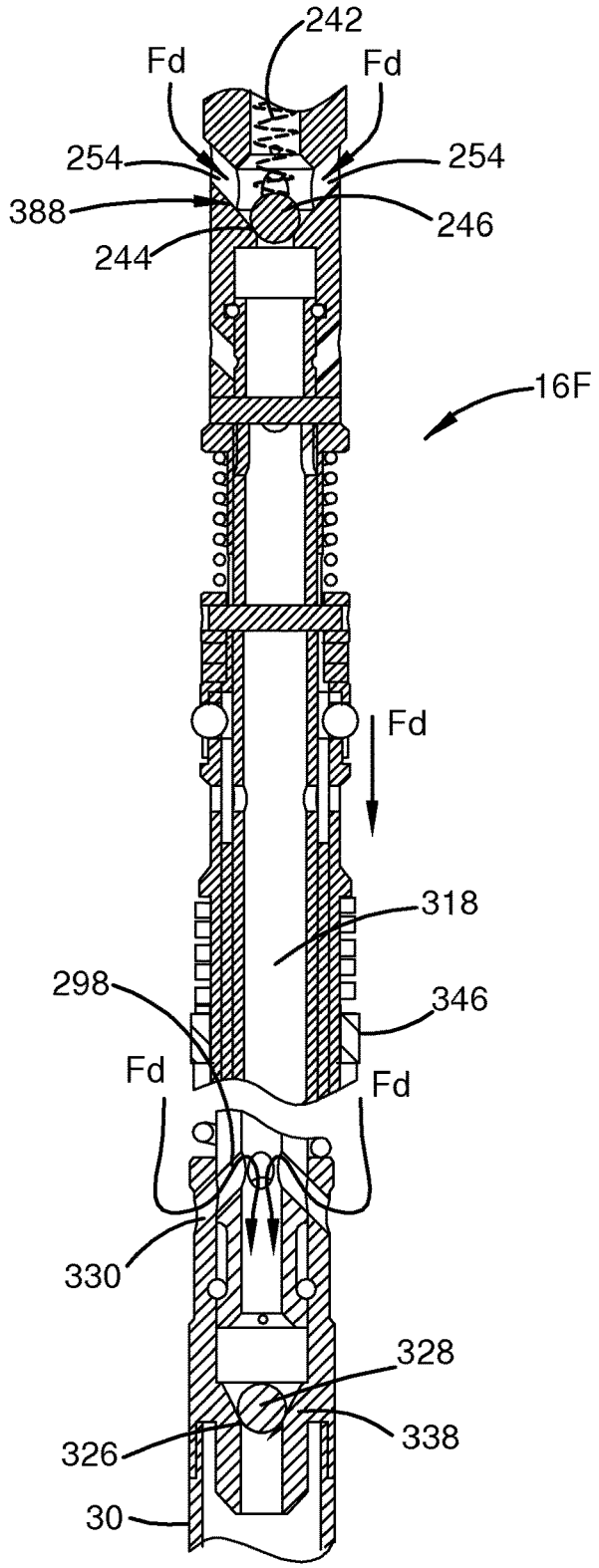
FIG. 11*b* is a section view of the head assembly shown in FIG. 11*a;*

FIGS. 11*a* and 11*b* show the rotationally fixed inner core barrel assembly 16F in the pumped in or landed mode. The pumped in mode of operation occurs when fluid Fd is pumped down through the drill string. The fluid Fd flows on an outside of the rotationally fixed inner core barrel assembly 16F. The check valve 388 is closed primarily by fluid pressure of the fluid Fd communicating through the ports 254 forcing the valve ball 246 on the seat 244. In the event that it is incorporated, the spring 242 further acts to close the check valve 388. The fluid Fd is also able to flow through the ports 298 and 330 to close the axial flow valve 338 before the landing shoulder 346 engages with and seals against the landing ring 396 (shown n FIG. 12*b*). Thus the pressure of the fluid Fd is able to act on the rotationally fixed inner core barrel assembly 16*f* to assist in delivering it to the downhole end of the drill string and land in the outer core barrel 20. The landing of the rotationally fixed inner core barrel assembly 16F in the core barrel 20 is signified by the landing shoulder 346 abutting a landing ring 396 (FIG. 12*b*).

Drilling Mode

FIGS. 12*a* and 12*b* show the rotationally fixed inner core barrel assembly 16F landed in the outer core barrel 20 with the landing shoulder 346 engaged with and abutting the landing ring 396. The rotationally fixed assembly 16F can move no further axially in the downhole direction. Accordingly as fluid pressure continues to increase on the rotationally fixed assembly 16F eventually the pressure exceeds the holding capacity of the detent system 392 and overcomes the bias of spring 230. This causes the valve body 222 to slide in a downhole direction relative to the spindle 218. As this occurs the snap ring 252 is forced out of the groove 262 and eventually lands in the groove 264. The spring 230 is also compressed. This motion of the body 222 relative to the spindle 218 is allowed for by virtue of the ports 266 in the spindle 218 and the slots 258 in the reduced diameter portion 226 of the valve body 222.

When the landing shoulder 346 abuts the landing ring 396 the latch balls 340 are radially aligned with the latch groove 398 formed in the inner circumferential surface of the outer core barrel 20. The above described axial motion of the upper outer valve body 222 relative to the spindle 218 also forces the downhole end 236 of the downhole portion 226 to slide into the annular gap 386 forcing the latch balls 340 in a radial outward direction so as to extend radially into the latch groove 398, but without engaging the greatest inner diameter of the latch groove 398 to minimise friction and wear during drilling mode.

The rotationally fixed inner core barrel assembly 16F is now latched in the outer core barrel 20 and is unable to move in the axial direction during drilling. Axial motion in the downhole direction is prohibited by the engagement of the landing shoulder 346 with the landing ring 396. Axial motion in an up-hole direction is prevented by the latch balls 340 being held to extend radially into the latch groove 398.

During the drilling mode the bistable valve 390 and shut off valve 336 are open and the axial flow valve 338 is shut. The axial flow valve 338 is shut by action of the fluid pressure acting on the valve ball 328 forcing onto the valve seat 326. This prevents fluid F from flowing into the core tube 30 which may otherwise wash away the collected core sample. A substantial seal is formed between the landing shoulder 346 and the landing ring 396. Therefore as fluid Fd if is pumped down the interior of the drill string it enters the axial passage 284 through the bistable valve 390 flows down spindle 218 to close the axial shut-off valve 338 and flows out of the passage 284 through the open shut-off valve 336. The fluid Fd then flows on the outside of the core tube 30 to exit the downhole end of the drill string adjacent the drill bit 408 (shown in FIG. 14*b*).

As previously mentioned the latch groove 398 and the latch balls 340 can be configured or otherwise arranged so that when the latch assembly 216 is in the latched configuration the balls 240 do not engage the shoulders of the latch groove 298. Indeed is further possible for this arrangement to cause the balls 240 to have no or only limited contact with the circumferential surface of the latch groove 398. Thus when the inner core barrel assembly 10 is latched to the core drill 28 it is believed that physical contact with the drill string at core barrel 20 may be limited to the contact between the landing shoulder 346 and the landing ring 396 at least while in the drilling mode.

When the drill string including the outer core barrel 20 is rotated the latch balls 340, outer sleeve 342, inner sleeve 344 and hanger spring 352 and landing shoulder 346 can also rotate. However torque from these rotating components is decoupled from the spindle 218 by action of the first bearing bush 348, second bearing bush 350, bearing washers 356 and 358 and the annular gap 364 between the outer surface of the spindle 218 and the inner circumferential surface of the inner sleeve 344.

In the presently disclosed embodiment the rotationally fixed core barrel assembly 16F the rotational position of the core tube 30, spindle 218, upper outer valve body 222 and the spear point 220 is fixed. As the core sample is rotationally fixed with reference to the core barrel 30 is also rotationally fixed with reference to the spindle 218, outer valve body 222 and indeed the spear point 220. Therefore a core orientation tool or system that is able to determine or measure core orientation by referencing to a known point on the core tube 30 can now determine or measure core orientation by reference to the rotational position of any one of the spindle 30, upper outer valve body 222 or the spear point 220. This opens the way for the visiting core orientation system or device to be run down the drill string after drilling has ceased and the core break has occurred to log or otherwise determine the position of a reference point on the spear point 220 as an indication of core orientation. In effect the embodiment of the rotationally fixed inner core barrel assembly 16F transfers tool face from the core tube 30 to the head assembly 28. Therefore there is no longer a need for a core rotation device or system to be physically held within the core tube 30 during drilling.

Blockoff/Over Drill Mode

Figure 13A:
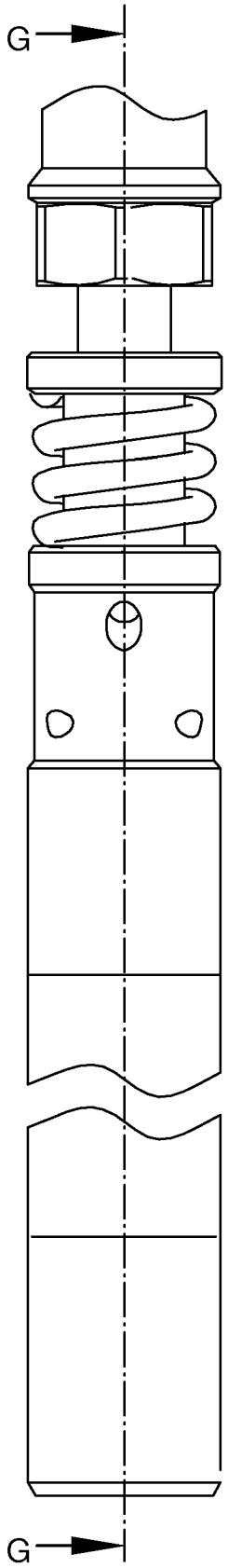
FIG. 13*a* is a front elevation of a portion of the rotationally fixed inner core barrel assembly when in a block off/over drill mode of operation.
Figure 13B:
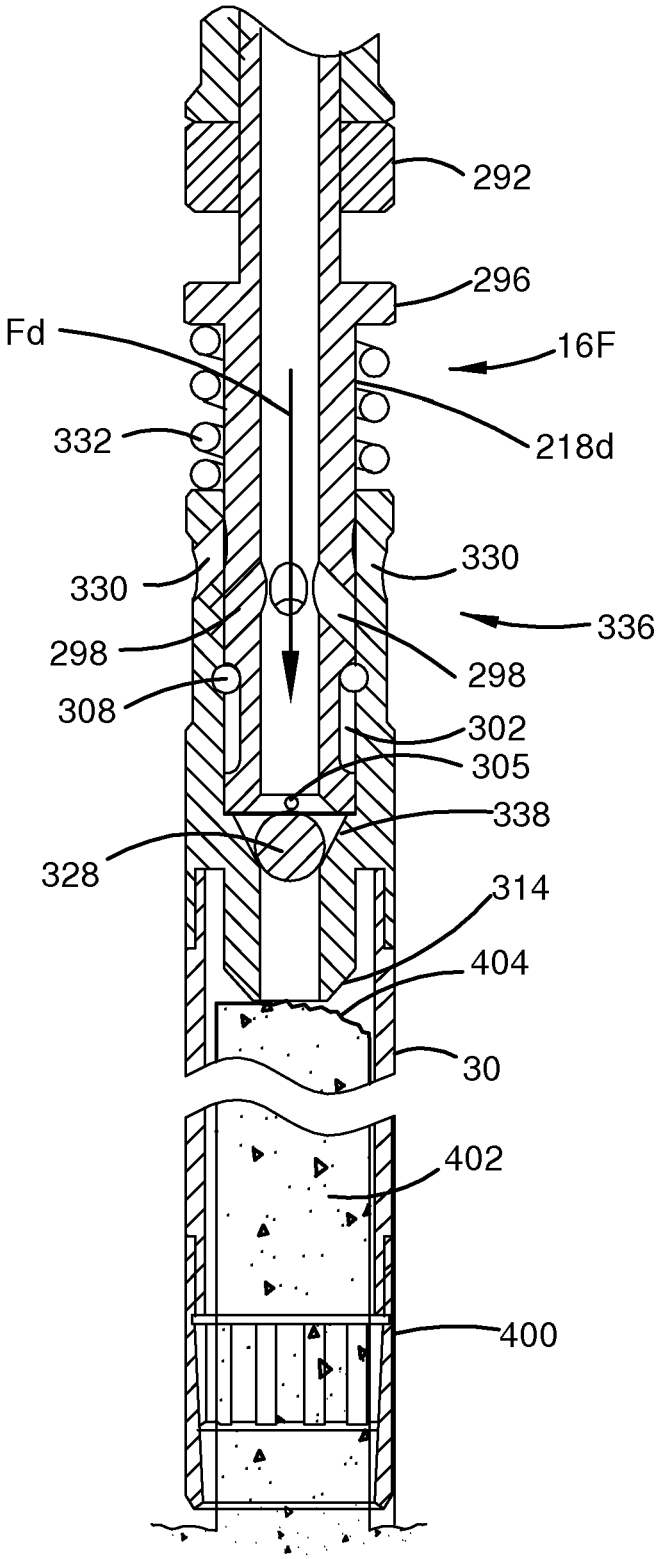
FIG. 13*b* is a section view of the portion of the rotationally fixed inner core barrel assembly shown in FIG. 13*a;*

FIGS. 13*a* and 13*b* depict the rotationally fixed inner core barrel assembly 16F in a block off or over drill mode. This mode of operation comes into action when either a core sample 402 is drilled to the extent that it overfills the core tube 30 and contacts the core abutment 314 or if the core sample 402 if highly fractured and sections of the core sample begin to wedge with each other against the inner diameter of the core tube 30 forcing the inner core tube 30 in an up-hole direction.

FIGS. 13*a* and 13*b* show a core lifter case assembly 400 fitted to a downhole end of the core tube 30 and a core sample 402 inside the core tube 30. Here the core drill operator has over drilled the core to the extent that a core face 404 has contacted the core abutment 314. It should be noted that due to its shape and configuration the core abutment 314 contacts a central region of the core face 404 rather than near a circumferential edge of the core face. This is beneficial as it minimises the risk of breaking the core face 404. It is generally regarded as good practice to maintain the core face 404 intact. The reasons for this are to (a) assist in rotational matching of a previously cut core, and (b) if a physical core orientation mark is placed on the core face for example by a China pencil prior to commencement of drilling the mark is generally near the circumferential edge.

Since the latch assembly 216 is still latched to the latch recess 398 of the outer core barrel 20 as shown in FIG. 12*b* and the spindle 218 (and its component parts 218*u* and 218*d*) are axially fixed, continued drilling results in the lower outer valve body 306 sliding in an up-hole direction compressing the spring 332. The abutment of the latch balls 340 against the up-hole shoulder of the latch recess 398 in turn progressively moves the ports 298 and 330 out of registration with each other until eventually they no longer overlap as shown in FIG. 13*b*. The shut-off valve 336 is now closed.

The axial flow valve 338 is also closed. This is by virtue of both the pressure of the fluid F acting on the valve ball 328 as well as the abutment of the valve for 328 with the downhole end 304 of the spindle 218 and/or pin 305.

With the valves 336 and 338 now shut fluid pressure within the drill string increases. This will be shown on a pressure dial being observed by the core drill operator. This would be understood by the core drill operator as indicating that either the core tube 30 is overfilled with core 402 or that sections of core sample have become wedged within the inner core tube 30 causing a core block or there is some other issue requiring immediate attention. In all instances the resultant action of the core drill operator will be to immediately stop drilling and to retrieve the rotationally fixed inner core barrel assembly 16F. Initially this will involve conducting a core break operation. This is described in the following section.

Core Break Mode

Figure 14A:
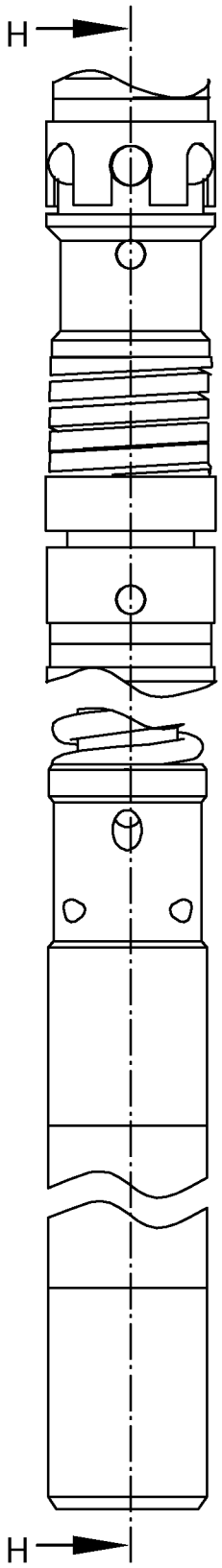
FIG. 14*a* is a front elevation of a portion of the rotationally fixed inner core barrel assembly when in a core break mode.
Figure 14B:
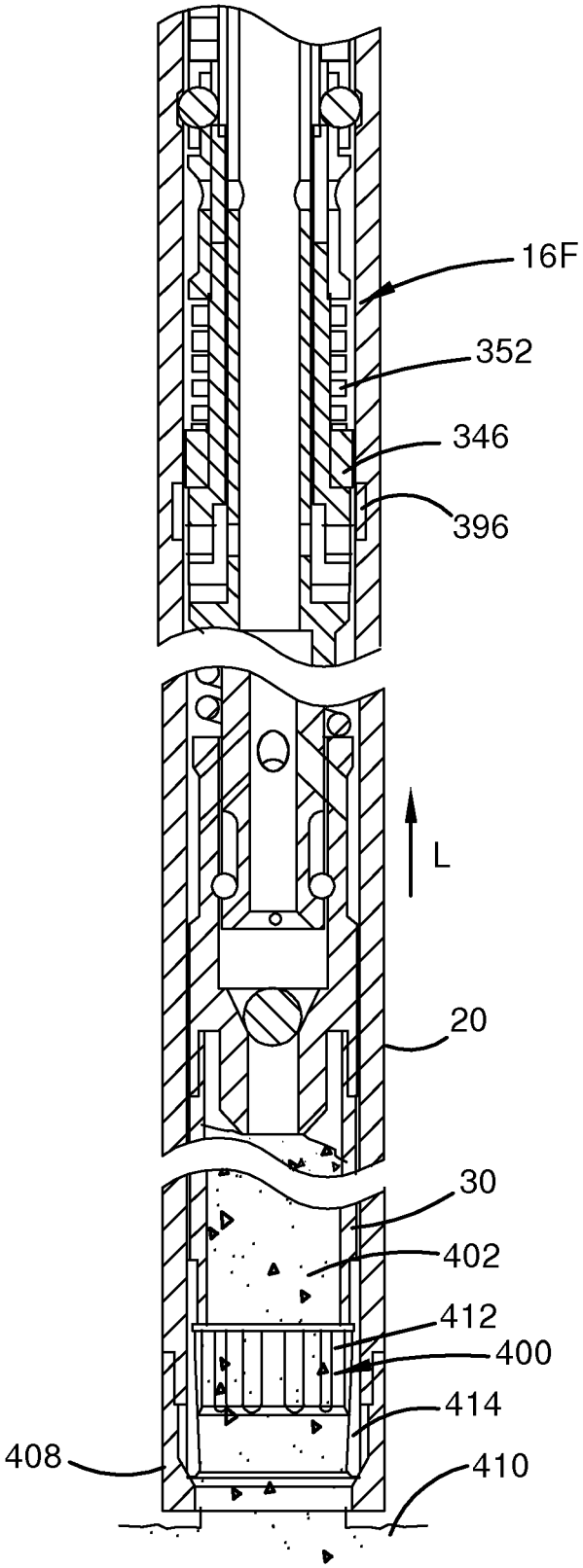
FIG. 14*b* is a section view of the portion of the rotationally fixed inner core barrel assembly shown in FIG. 14*a* when inside an outer core barrel of a drill string and when in the core break mode.

FIGS. 14*a* and 14*b* show the operation of the rotationally fixed assembly 16F during core break. During core break the rotation of the drill string and the core barrel assembly 20 has ceased. The core sample 402 remains attached to the surrounding strata 410. To break the core sample 402 the drill string is lifted by the drill rig at the surface. The lifting force L translates the drill string in the up-hole direction.

Continued application of the lifting force L now initially lifts both core barrel 20 and then the inner core barrel assembly 10. This initially brings into action the core lifter assembly 400 which comprises a core lifter spring 412 and a core lifter case 414. The core lifter spring 412 grips the outer surface of the core sample 402. Now the rotationally fixed assembly 16F is being held stationary while lifting force L is continually applied to the outer core barrel 20. The lifting force L is transferred by the contact between the landing shoulder 346 and the landing ring 396 to the hanger spring 352. Therefore the hanger spring 352 compresses during the core breaking operation to enable a progressive application of tension to the core sample 402 which is retained in the core tube 30. During this progressive application of tension and compression of the hanger spring 352 the outer core barrel 20 moves relative to the rotationally fixed inner core barrel assembly 16F until the drill bit 408 contacts the end of the core lifter case 414. This contact transfers all of the lifting force L from the core lifter assembly 400 to the outer core barrel 20 and drill string resulting in an eventual breakage of the core sample 402 from the strata 410.

Core Retrieval

In order to retrieve the core sample 402, an overshot 34 is run down the drill string on a wire line to engage the spear point 220. During this process a visiting orientation device 14 including for example but not limited to a borehole surveying tool can be attached to or housed within the overshot 34 to acquire core orientation and other critical downhole data.

When the overshot is engaged with the spear point 220 (shown in FIG. 10*b*) the wire line is reeled in. At this time the latch assembly 216 is still engaged with the outer core barrel 20. Also the detent system 392 is in the configuration shown in FIG. 12*b*. Tension in the wire line is transferred to the upper outer valve body 222. The tension initially overcomes the detent system 392 increasing the diameter of the snap ring 250 to release it from the groove 264 in the spindle 218. The valve body 222 slides in the upward direction until the pin 268 abuts an upper end of the port 266. This coincides with the snap ring 250 relocating in the groove 262. The sliding motion of the valve body 222 also results in the downhole end 236 moving away from the latch balls 340 so that it no longer occupies the annular gap 386. Thus the detent system 392 and moreover the latch assembly 216 is now in the configuration shown in FIG. 7*b*.

The latch balls 340 can now move in a radial inward direction into the gap 386. This releases the latch assembly 216 from the latch groove 398. The entire rotationally fixed inner core barrel assembly 16F is now reeled in with the overshot assembly on the wire line cable.

Further Embodiments Of The Rotationally Fixed Assembly 16F

Whilst a specific embodiment of the rotationally fixed assembly 16F has been described, it should be appreciated that other forms are possible.

For example the spindle/inner tube 218 is shown as comprising two portions 218*u* and 218*b* which a screw coupled together. This allows some adjustment in the overall length of the spindle 218 and corresponding rotationally fixed inner core barrel assembly 16F. However if this adjustment is not required then the spindle 218 can be made as a single piece.

In a further example the latch member 340 need not be in the form of balls as currently described. The latch members can for example alternately be in the form of hinged latches or pivoting latches.

To improve the axial strength of the connection between the downhole portion 218*d* of the spindle 218 and the lower outer valve body 306, presently provided by the roll pins 308 which ride in the recesses 302, a shoulder could be incorporated into the upper end of the lower outer valve body 306 that slidably mates with a shoulder on the spindle portion 218*d*. This mating of shoulders during core break and retrieval of the rotationally fixed inner core barrel assembly 16F would take the load instead of relying on the roll pins 308. The roll pins 308 would then be solely for fixing the axial position of the inner core tube 30 and spindle/inner tube 218.

Integrated Payload Delivery and Retrieval System Embodiment

Figure 15A:
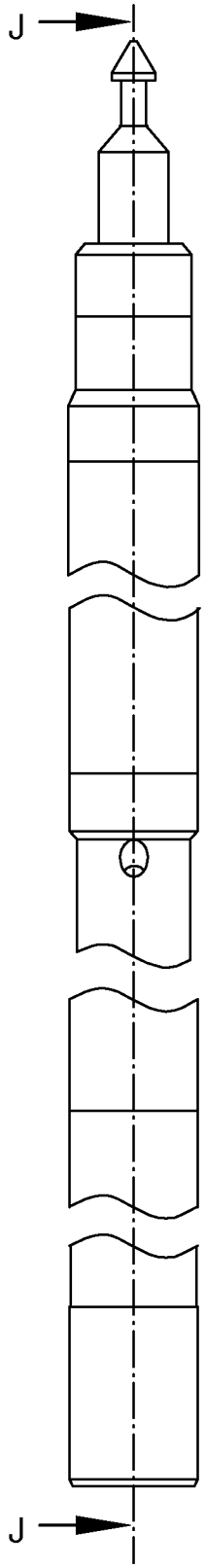
FIG. 15*a* is a front elevation of an upper portion of a second embodiment of the rotationally fixed inner core barrel assembly which incorporates an upper payload sub.
Figure 15B:
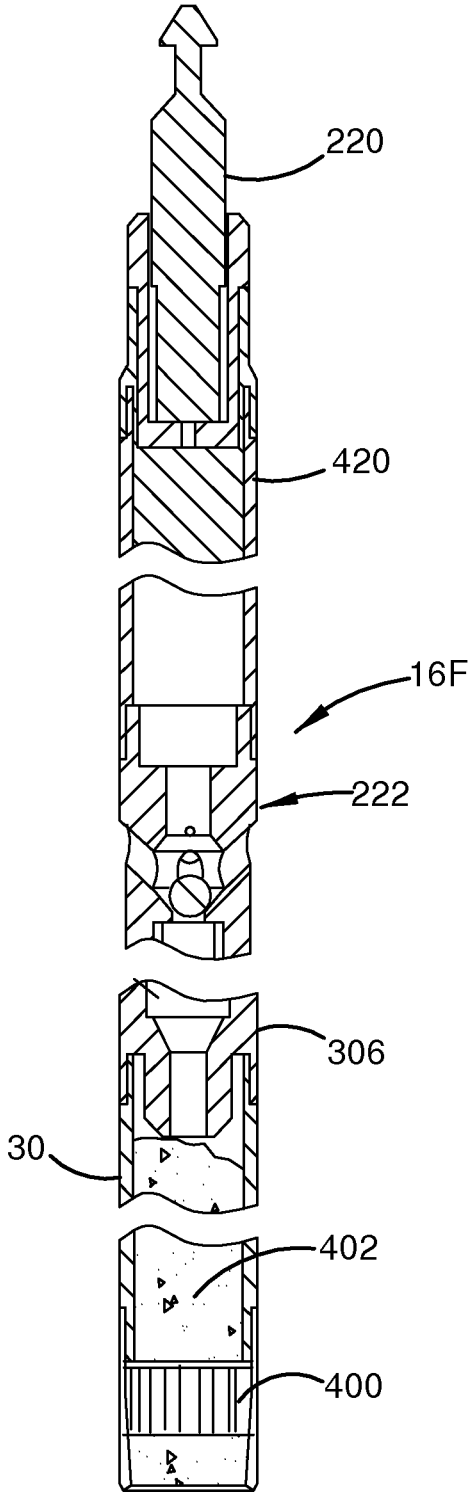
FIG. 15*b* is a section view of the portion of the rotationally fixed inner core barrel assembly shown in FIG. 15*a;*
Figure 16A:
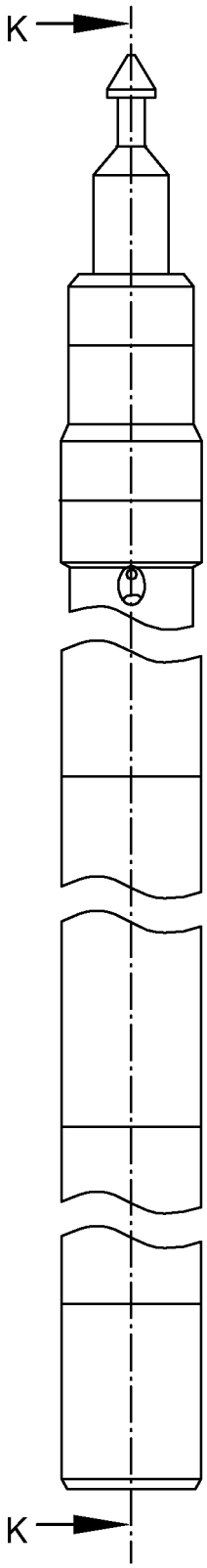
FIG. 16*a* is a front elevation of an upper portion of an alternate form of the rotationally fixed inner core barrel assembly which incorporates a lower payload sub.
Figure 16B:
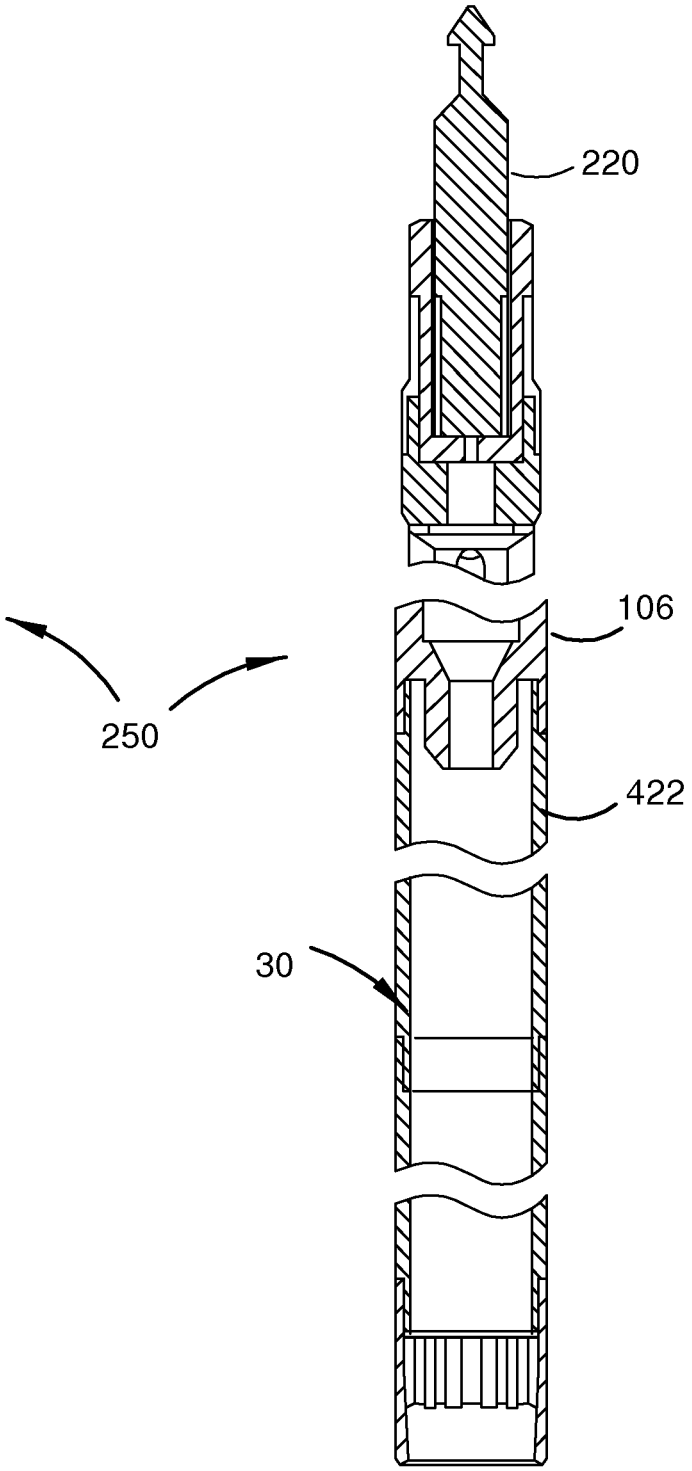
FIG. 16*b* is a section view of the portion of the rotationally fixed inner core barrel assembly shown in FIG. 16*a;*

FIGS. 15*a* and 15*b* show further variation of the rotationally fixed assembly 16F in which an upstream payload sub 420 is connected between the coupling mechanism/spear point 220 and the upper outer valve body 222. The payload sub 420 can be used to carry any desired payload including for example but not limited to a power source, a motor and other mechanical devices to aid the drilling or coring process, a pump-in seal, orientation sensors, vibration, pressure and motion sensors, cameras, borehole or rock scanning and sampling devices and other electronic, digital or radiological monitoring or analysis equipment.

In addition or as an alternative a downstream payload sub may also be located between the latch assembly 216 and a downhole end of the core tube 30. For example in FIGS. 16*a* and 16*b* a downstream payload sub 422 is shown located within the core tube 30 adjacent to the lower outer valve body 306. In such an arrangement depending on whether or not the device is also used to retrieve core sample the downstream payload sub 422 may be formed as an annular cylinder having a passage through which fluid can flow.

Figures 17A, 17B:
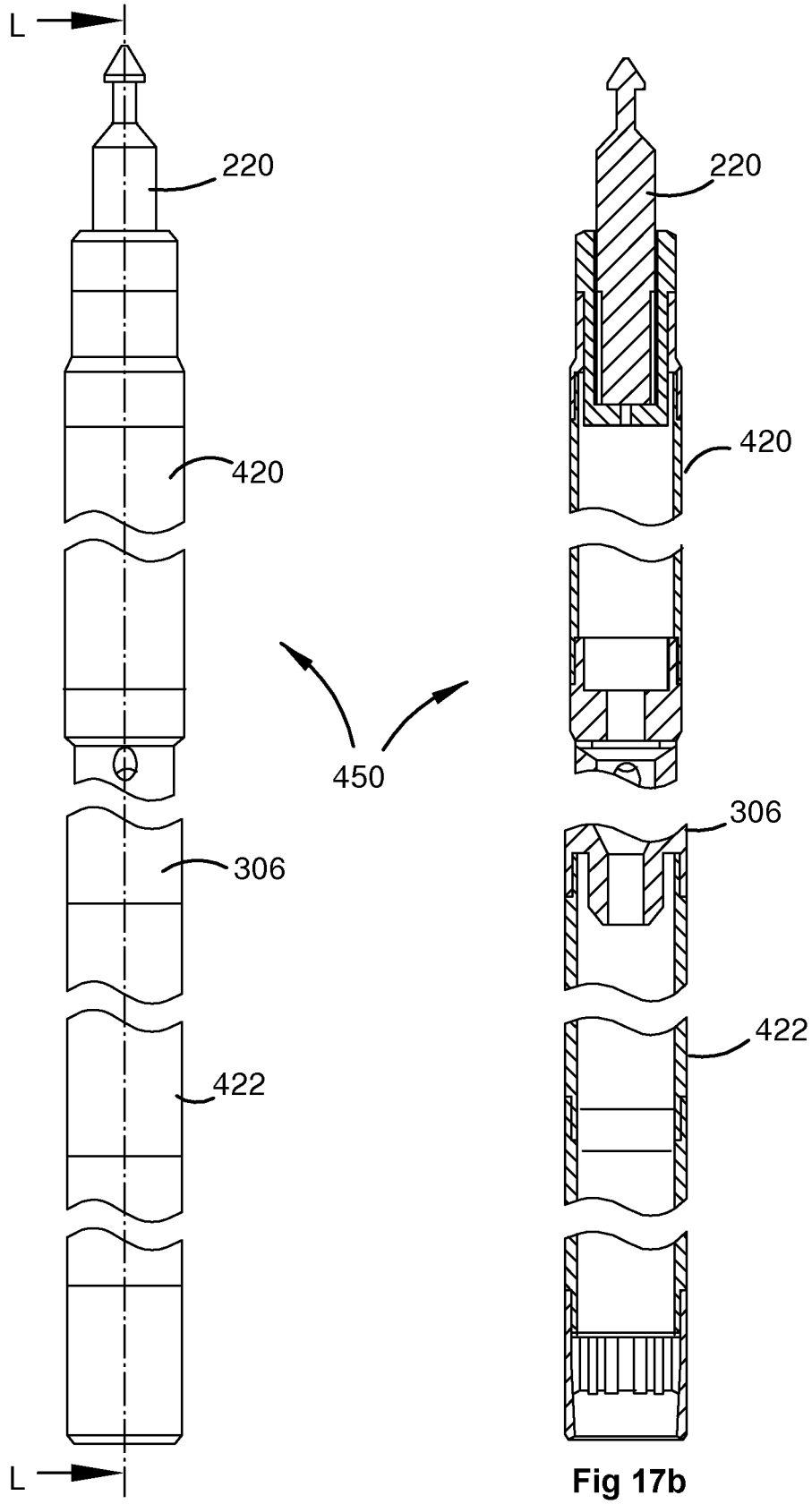
FIG. 17*a* is a front elevation of an upper portion of yet another form of the rotationally fixed inner core barrel assembly which incorporates an upper payload sub and a lower payload sub.
FIG. 17*b* is a section view of the portion of the rotationally fixed inner core barrel assembly shown in FIG. 17*a.*

FIGS. 17*a* and 17*b* depict a variation where both an upstream payload sub 420 and a downstream payload sub 422 are incorporated. This enables the carrying of additional payload as described above on opposite sides of the latch assembly 216 and in particular the landing shoulder 346.

Indeed the embodiments which incorporate one or both of payload subs may be considered to be an integrated payload delivery and retrieval system 450 rather than the rotationally fixed inner core barrel assembly 16F. This is because the integrated system 450 can be used primarily or indeed solely to deliver various tools and monitoring or sampling systems down the hole independent of the collection of core sample. When there is no need to collect a core sample the core tube 30 can be simply unscrewed and the downhole payload sub can then be attached to the lower outer valve body 306. Alternately the core tube 30 can be maintained and used itself as the downhole payload sub. In this variation the core lifter case assembly 400 would be unscrewed from the downhole end of the core tube 30.

As will be understood by those skilled in the art embodiments of the disclosed rotationally fixed inner core barrel assembly 16F do not require a core orientation device or system downhole of the landing shoulder 346. This is because, as mentioned above, tool face is in effect mechanically transferred to the back-end of the inner core barrel assembly 16F. Accordingly core orientation data may be acquired by a visiting core orientation system or borehole surveying tool 14. Prior art inner core barrel assemblies which require a retained core orientation device are longer in length down-hole of the landing shoulder in order to accommodate the core orientation device while still capturing a standard length of core sample. This necessitates the use of either an extension sub between downhole end of the drill string and the up-hole end of the outer core barrel, or a specially manufactured lengthened outer core barrel.

As will also be understood by those skilled in the art as embodiments of the disclosed inner core barrel assembly 16F do not require traditional blow off rubberised discs to cut off water flow if a core block or over drilling of the core sample occurs because of the simplified and more compact design of the axial flow valve 338 and the removal of a traditional spindle bearing and hanger bearing assembly from below the landing shoulder 346 to above the landing shoulder 346, additional payload space can be created between the lower outer valve 306 and the inner core tube 30. This additional payload space can be used for additional core sample to be drilled, a core orientation device, or other electronic or mechanical devices to aid the drilling or data collection process.

In the claims which follow, and in the preceding description, except where the context requires otherwise due to express language or necessary implication, the word "comprise" and variations such as "comprises" or "comprising" are used in an inclusive sense, i.e. to specify the presence of the stated features but not to preclude the presence or addition of further features in various embodiments of the system and method as disclosed herein.

The invention claimed is:

1. An inner core barrel assembly for use with a drill string of a core drill, the inner core barrel assembly comprising:

a coupling mechanism at an up-hole end of the inner core barrel assembly and capable of releasable connection with a retrieval system;

a core tube for receiving a core sample cut by a core drill in which the inner core barrel assembly is installed;

a spindle which is rotationally fixed to the coupling mechanism and the core tube;

wherein the spindle is arranged to rotationally decouple the core tube from the drill string;

a latch assembly arranged to latch the spindle in an axially fixed position in and relative to the drill string wherein the latch assembly comprises a landing shoulder which is arranged to support the inner core barrel assembly on a landing ring within the core drill; and a hanger spring located between the landing shoulder and the latch members and arranged to compress during a core breaking operation to enable a progressive application of core break tension to the core sample as well as to provide a shock absorbing function when the inner core barrel assembly lands on the landing ring.

2. The inner core barrel assembly according to claim 1, wherein the spindle extends through the latch assembly.

3. The inner core barrel assembly according to claim 1, wherein the spindle comprises a tube.

4. The inner core barrel assembly according to claim 1, further comprising a core abutment coupled to the spindle and located in the core tube, the core abutment extending along a central axis of the core tube and having an outer circumferential surface spaced by an annular gap from an inner circumferential surface of the core tube.

5. The inner core barrel assembly according to claim 4 wherein the core abutment is configured to abut an axial end of a core sample at a location inboard of an outer circumferential surface of the core sample.

6. The inner core barrel assembly according to claim 1 wherein the latch assembly comprises a plurality of latch members movable in a radial direction between a latch position where the latch members protrude in a radial outward direction form an outer circumferential surface of an outer sleeve and a release position where the members are able to retract to lie within the outer circumferential surface of the outer sleeve.

7. The inner core barrel assembly according to claim 6 wherein the coupling mechanism is capable of moving axially relative to the spindle to lock the latch members in the latch position.

8. An inner core barrel assembly for use with a drill string of a core drill, the inner core barrel assembly comprising:

a coupling mechanism at an up-hole end of the inner core barrel assembly and capable of releasable connection with a retrieval system;

a core tube for receiving a core sample cut by a core drill in which the inner core barrel assembly is installed;

a spindle which is rotationally fixed to the coupling mechanism and the core tube;

wherein the spindle is arranged to rotationally decouple the core tube from the drill string;

a core abutment coupled to the spindle and located in the core tube, the core abutment extending along a central axis of the core tube and having an outer circumferential surface spaced by an annular gap from an inner circumferential surface of the core tube wherein the core abutment is configured to abut an axial end of the core sample at a location inboard of an outer circumferential surface of the core sample; and a latch assembly arranged to latch the spindle in an axially fixed position in and relative to the drill string wherein the latch assembly further comprises an inner sleeve which is coupled to the outer sleeve and through which the spindle passes, the inner sleeve and spindle relatively dimensioned to form an annular gap therebetween.

9. The inner core barrel assembly according to claim 8, wherein the spindle is configured or otherwise arranged to enable communication between axially opposite ends of the latch assembly.

10. The inner core barrel assembly according to claim 9 wherein the spindle is arranged to be configured or otherwise arranged to enable one or a combination of two or more of: electronic communication; optical communication; mechanical communication; and fluidic communication between axially opposite ends of the latch assembly.

11. The inner core barrel assembly according to claim 8 wherein the latch assembly comprises a landing shoulder which is arranged to support the inner core barrel assembly on a landing ring within the core drill.

12. The inner core barrel assembly according to claim 11 wherein the latch assembly is configured so that when the landing shoulder is in contact with the landing ring and the latch members are in the latch position at least some of the latch members are spaced from contact with an inner surface of the drill string.

13. A method of enabling the acquisition of borehole survey data and core orientation data in a single instrument trip in a core drill having a drill string and an inner core barrel assembly having a longitudinal axis and the inner core barrel assembly comprising a coupling mechanism at an up-hole end of the inner core barrel assembly and capable of releasable connection with a retrieval system;

a core tube for receiving a core sample cut by the core drill in which the inner core barrel assembly is installed; and a spindle which is rotationally fixed to the coupling mechanism and the core tube wherein the spindle is arranged to rotationally decouple the core tube from the drill string, a latch assembly arranged to latch the spindle in an axially fixed position in and relative to the drill string wherein the latch assembly comprises a landing shoulder which is arranged to support the inner core barrel assembly on a landing ring within the core drill; and a hanger spring located between the landing shoulder and latch members and arranged to compress during a core breaking operation to enable a progressive application of core break tension to the core sample as well as to provide a shock absorbing function when the inner core barrel assembly lands on the landing ring, the method comprising:

running a borehole survey tool through the drill string in which is installed the inner core barrel assembly wherein the borehole survey tool is arranged to at least log its position in three-dimensional space;

enabling the inner core barrel assembly to provide or facilitate detection of an indication tool face of the core sample held in the inner core barrel assembly; and transferring the indication of tool face to the borehole survey tool.

* * * * *